US010172753B2

(12) United States Patent
Tessmer et al.

(10) Patent No.: US 10,172,753 B2
(45) Date of Patent: Jan. 8, 2019

(54) PATIENT SUPPORT LIFT ASSEMBLY

(71) Applicant: Stryker Corporation, Kalamazoo, MI (US)

(72) Inventors: Brian J. Tessmer, Kalamazoo, MI (US); Richard A. Derenne, Portage, MI (US); Gary L. Bartley, Kalamazoo, MI (US); Bryan Garfoot, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 265 days.

(21) Appl. No.: 15/133,835

(22) Filed: Apr. 20, 2016

(65) Prior Publication Data

US 2016/0302985 A1 Oct. 20, 2016

Related U.S. Application Data

(60) Provisional application No. 62/149,963, filed on Apr. 20, 2015.

(51) Int. Cl.
*A61G 7/012* (2006.01)
*A61G 7/005* (2006.01)

(52) U.S. Cl.
CPC ..... *A61G 7/012* (2013.01); *A61G 7/005* (2013.01)

(58) Field of Classification Search
CPC ..... A61G 7/012
USPC ..... 5/611, 600, 11
See application file for complete search history.

(56) References Cited

U.S. PATENT DOCUMENTS

| | | | | |
|---|---|---|---|---|
| 3,203,670 | A * | 8/1965 | Farris | B66F 7/0666 108/120 |
| 5,317,769 | A | 6/1994 | Weismiller et al. | |
| 6,071,228 | A | 6/2000 | Speraw et al. | |
| 7,296,312 | B2 | 11/2007 | Menkedick et al. | |
| 7,690,059 | B2 | 4/2010 | Lemire et al. | |
| 2014/0325759 | A1 | 11/2014 | Bly et al. | |

OTHER PUBLICATIONS

International Search Report for PCT/US2016/028424, the international countrpart to U.S. Appl. No. 15/133,835.
International Written Opinion for PCT/US2016/028424, the international countrpart to U.S. Appl. No. 15/133,835.

* cited by examiner

*Primary Examiner* — Fredrick C Conley
(74) *Attorney, Agent, or Firm* — Warner Norcross + Judd LLP

(57) ABSTRACT

A patient support apparatus includes a frame supported relative to a floor, the frame configured to support a deck for supporting a patient thereon, and a lift assembly for raising or lowering the frame relative to the floor. The lift assembly includes lifting legs coupled to the frame and an actuator with a body and an extendible member. The body and the extendible member define a stroke length extending along a stroke axis, with the actuator mounted in the lifting assembly between two levers.

21 Claims, 45 Drawing Sheets

PATIENT SUPPORT LIFT ASSEMBLY

This application claims the benefit of Provisional App. Ser. No. 62/149,963, entitled PATIENT SUPPORT LIFT ASSEMBLY, which is incorporated by reference herein in its entirety.

BACKGROUND OF THE INVENTION

The present invention relates to a patient support apparatus with a lift assembly for raising or lowering a patient support apparatus deck relative to a floor surface. More specifically, the present invention relates to a patient support apparatus with a lift assembly that can lower the patient support apparatus deck to a very low height while achieving a sufficient range of travel to reach a working height where a caregiver can access the patient at a height that is comfortable for the caregiver.

SUMMARY OF THE INVENTION

A lift mechanism is described that is compact at a very low height while still providing a long range of travel to raise the patient support apparatus deck to a height that is suitable for caregivers. Further, the lift mechanism is configured so that it can raise or lower one end of the patient support apparatus to orient the patient support apparatus deck in a Trendelenburg or reverse Trendelenburg position.

In one form, a patient support apparatus includes a base, a frame supported relative to a floor by the base, with the frame configured to support a deck for supporting a patient thereon. The patient support apparatus further includes a lift assembly for raising or lowering the frame relative to the base. The lift assembly includes a leg assembly coupled to the frame and to the base, and further an actuator. The leg assembly includes at least one leg, with the actuator coupled to the leg with a first lever and coupled the base with a second lever.

In one aspect, the lifting leg includes an upper pivot connection to the frame, a lower pivot connection to the base, and a folding pivot axis between the upper and lower pivot connections, with the first lever coupled to the lifting leg at the folding pivot axis.

In a further aspect, the lower pivot connection comprises a sliding pivot connection, with the sliding pivot connection sliding along a long axis of the base.

According to another aspect, the first lever comprises an offset frame. The offset frame is mounted about the folding pivot axis and pivotally mounted to the lower pivot connections.

In yet a further aspect, the offset mount comprises a pair of spaced plates, with the plates supporting a transverse pin, and the actuator pivotally coupled to the transverse pin.

According to another aspect, the lift assembly includes a head end leg assembly and a foot end leg assembly. The head end leg assembly is independent from the foot end leg assembly.

In a further aspect, each of the head end leg assembly and a foot end leg assembly includes a lifting leg and an actuator.

In yet another embodiment, wherein the frame has a foot end and a head end. The lifting leg of the head end leg assembly is pivotally mounted at a fixed pivot connection at or near the head end of the frame, and the lifting leg of the foot end leg assembly is pivotally mounted at a movable fixed pivot connection at or near the foot end of the frame.

In a further aspect, the fixed pivot connection is offset below the frame.

In yet further aspects, wherein the movable pivot connection is offset below the frame.

In one aspect, wherein each of the head end leg assembly and the foot end leg assembly includes a pair of the lifting legs.

In yet a further aspect, wherein each of the actuators is mounted in a respective leg assembly between a first lever and a second lever. The first levers comprise offset frames, which are pivotally mounted between the pair of the lifting legs of the respective leg assembly.

According to yet a further aspect, wherein the offset frames each comprise a pair of spaced plates. Each of the pair of spaced plates supports a transverse pin, with the actuators pivotally coupled to the transverse pins.

In yet further aspects, the head end leg assembly and the foot end leg assembly each have an inverted Y-shaped configuration when the lift assembly moves the frame to a raised position.

In yet further aspects, the head end leg assembly and the foot end leg assembly each have an upright Y-shaped configuration when the lift assembly moves the frame to a raised position.

In another embodiment, a patient support apparatus includes a base, the base having a base frame, a support frame supported relative to the base, and the support frame configured to support a deck for supporting a patient thereon. The apparatus further includes a head end actuator, a foot end actuator, and a lift assembly for raising or lowering the frame relative to the base. The lift assembly includes a head end leg assembly and a foot end leg assembly. Each of the leg assemblies has a Y-shaped configuration when the frame is raised and is folded when the frame is lowered. The head end leg assembly and the foot end leg assembly each have a pair of lifting legs. The lifting legs are pivotally mounted at their upper ends to the frame and pivotally mounted at their lower ends to the base. Each of the lifting legs has a folding pivot axis, and each of the head end and foot end actuators have a lower pivot connection below the base frame and an upper pivot connection above the folding pivot axis of a respective pair of lifting legs of the lifting legs.

In one aspect, the head end leg assembly and the foot end leg assembly each have an inverted Y-shaped configuration when the lift assembly moves the support frame to a raised position.

In another aspect, the lifting legs of the head end leg assembly are pivotally mounted at fixed pivot connections at or near the head end of the frame. The lifting legs of the foot end leg assembly are pivotally mounted at movable pivot connections at or near the foot end of the frame.

In a further aspect, the fixed pivot connections are offset below the frame.

In yet another aspect, the movable pivot connections are offset below the frame.

According to yet another aspect, each of the actuators is mounted in a respective leg assembly between a first lever and a second lever, with the first levers comprising pivotal frames. Each of the pivotal frames is mounted between the pair of the lifting legs of the respective leg assembly.

In another embodiment, a patient support apparatus includes a frame supported relative to a floor, with the frame configured to support a cushion for supporting a patient thereon. The patient support apparatus further includes a lift assembly for raising or lowering the frame relative to the floor. The lift assembly includes lifting legs coupled to the frame and an actuator. The actuator includes a body and an extendable member, with the body and extendable member defining a stroke length. The actuator is mounted in the lifting assembly between two mounts over distance less than the stroke length of the actor to thereby reduce the installation length of the actuator.

In one aspect, the lifting legs include a pair of head end lifting legs and a pair of foot end lifting legs. The head end lifting legs each have a head end crank arm. The foot end lifting legs also each have a foot end crank arm. One of the mounts is coupled to one of the pairs of the lifting legs, and another of the mounts is coupled to its respective crank arm.

According to another aspect, one of the mounts comprises an offset mount having an offset portion offset along the stroke axis of the actuator to thereby reduce the installation length of the actuator.

In further aspect, the offset mount includes a frame structure with a first connection mounted to one end of the actuator and a second connection spaced from the first connection. The second connection is coupled to the respective crank arms.

In a further embodiment, the offset mount further comprises a pair of spaced webs. The spaced webs are each mounted to the respective crank arms on one end thereof and mounted to the frame structure on opposed end thereof. For example, the frame structure may form a box.

According to yet another embodiment, the patient support apparatus further comprises a plurality of bearings, with the lift assembly raising the frame relative to the bearings.

In another aspect, the cushion comprises a mattress.

In yet another embodiment, the actuator comprises a first actuator, with the lift assembly further comprising a second actuator. The second actuator is mounted between another of the pairs of the lifting legs and their respective crank arms.

Optionally, the second actuator includes a stroke length and is mounted between the other pair of lifting legs and its respective crank arms over distance less than the stroke length of the second actuator to thereby reduce the installation length of the second actuator.

In a further aspect, the frame has a foot end and a head end with the head end lifting legs pivotally mounted at a fixed pivot axis at or near the head end of the frame. The foot end lifting legs are pivotally mounted at a fixed pivot axis at or near the foot end of the frame. The first actuator is mounted at an upper end of the head end lifting legs, with the second actuator mounted at an upper end of the foot end lifting legs.

In yet further aspects, each of the pairs of lifting legs includes a cross-member joining the respective upper ends of the lifting legs. The first actuator is mounted to the cross-member of the head end lifting legs, and the second actuator is mounted to the cross-member of the foot end lifting legs.

In one aspect, the crank arms are pivotally mounted to medial portions of their respective lifting legs.

In yet a further embodiment, the patient support apparatus further includes a base, with the crank arms pivotally mounted to the base at one end thereof and pivotally mounted at their opposed ends to their respective lifting legs.

According to yet a further aspect, the lifting legs are pivotally and slidably mounted to the base at their respective lower ends. Additionally, the lifting legs and the crank arms have a Y-shaped configuration when the lift assembly moves the frame to a raised position. Further, the lifting legs and the crank arms may align in a common plane when the lift assembly moves the frame to a lowermost position.

According to yet another embodiment, a patient support apparatus includes a base and a frame supported relative to the base, with the frame configured to support a cushion for supporting a patient thereon. The patient support apparatus further includes a lift assembly for raising or lowering the frame relative to the base. The lift assembly includes a pair of head end lifting legs, a pair of foot end lifting legs, a foot end crank arm associated with each of the foot and lifting legs, and a head end crank arm associated with each of the head end lifting legs. The lifting legs are pivotally mounted at their upper ends about fixed pivot axes to the frame and pivotally and slidably mounted at their lower ends about sliding pivot axes to the base. The crank arms are pivotally mounted to the base at one end thereof and pivotally mounted at their opposed ends to their respective lifting legs. Further, the lifting legs and the crank arms form a Y-shaped configuration when the lift assembly moves the frame to its raised position.

In one aspect, the fixed pivot axes align in a common plane when the lift assembly moves the frame to its lowermost position.

In another aspect, the lift assembly further includes a head end actuator and a foot end actuator. One end of the foot end actuator is mounted to the foot end lifting legs, and one end of the head end actuator is mounted to the head end lifting legs.

In yet a further aspect, another end of the head end actuator is coupled to the head end crank arms, and another end of the foot end actuator is coupled to the foot end crank arms.

In yet a further aspect, each of the actuators includes a body with an extendable member. Each body and its respective extendable member define a stroke length between their respective attachment points. Each actuator is mounted between its respective pair of lifting legs and its respective crank arms over distance less than the stroke length to thereby reduce the installed length of each actuator.

For example, the actuator may comprise a cylinder, such as electric or pneumatic cylinder, with the cylinder including the body and extendable member.

According to yet another embodiment, a patient support apparatus includes a base with a plurality of bearings, a frame supported relative to base, with the frame configured to support a cushion for supporting a patient thereon, and a lift assembly for raising or lowering the frame relative to the base. The lift assembly is configured to lower the frame between an upper most position and a lowermost position wherein the frame is less than 13 inches, and optionally less than 12 inches, off the floor, and wherein the clearance beneath the frame is sufficient, for example about 5 to 6 inches above the floor, to allow a base of an overbed table or a patient lift to be extended under the patient support apparatus.

According to yet another embodiment the patient support apparatus includes a base with a plurality of bearings, a frame supported relative to the base, with the frame configured to support a cushion for supporting a patient thereon, and a lift assembly for raising or lowering the frame relative to the base. The lift assembly includes a pair of head end lifting legs pivotally mounted at their upper ends at fixed pivot axes to the frame and a pair of foot end lifting legs pivotally mounted at their upper ends at fixed pivot axes to the frame. The lifting legs are pivotally and slidably mounted at their lower ends at slidable pivot axes to the base so that when the frame is lowered the lower ends of the lifting legs move inwardly toward the middle of the frame.

In one aspect, the base defines an upper boundary and a lower boundary. When the frame is moved to its lowermost position, the lifting legs lie in the base and between the upper boundary and the lower boundary.

In a further aspect, the lift assembly includes crank arms pivotally mounted at fixed pivot axes to each of the lifting arms. For example, the crank arms may be pivotally mounted to medial portions of their respective lifting legs. Further, the crank arms may be pivotally mounted to the base at one end thereof and pivotally mounted at their opposed ends to their respective lifting legs.

In a further aspect, the fixed pivot axes align in a common plane when the frame is lowered to its lowermost position.

According to yet another embodiment, a patient support apparatus includes a base, a frame supported relative to the base, with the frame configured to support a cushion for supporting a patient thereon, and a lift assembly for raising or lowering the frame relative to the base. The lift assembly includes a pair of head end lifting legs pivotally mounted at their upper ends to the frame and at their low ends to the base. The lift assembly further includes a pair of foot end lifting legs pivotally mount at their upper ends to the frame and at their lower ends to the base. A pair of actuators is mounted to the lifting legs for moving the lifting legs, with the actuators not mounted to the frame wherein the forces of the actuators are applied to the lifting legs and not applied to the frame.

In one aspect, the base includes base frame members that define an upper boundary and a lower boundary. When the frame is moved to its lowermost position, the lifting legs lie between the base frame members and between the upper boundary and the lower boundary.

In yet another aspect, the lift assembly further includes crank arms pivotally mounted at fixed pivot axes to each of the lifting legs. When the frame is moved to its lowermost position, the lifting legs and the crank arms lie between the base frame members and between the upper boundary and a lower boundary.

According to yet another form invention a method of raising or lowering the deck the patient support apparatus between a full height position and a low height position relative to the floor, while maintaining clearance between the deck and the floor when in the low height position, includes the steps of providing an actuator with a stroke length, extending the actuator to raise the deck or retracting the actuator to lower the deck, and mounting the actuator in the patient support apparatus between two mounts that are spaced less than the stroke length of the actuator to reduce the installation length of the actuator.

In yet another embodiment, a method of raising or lowering the deck of a patient support apparatus between a full height position and a low height position relative to a base supported on a floor, while maintaining clearance between the deck and the floor when in the low height position, includes the steps of mounting the deck relative to the base with independent head and foot end leg assemblies and folding the leg assemblies inward into the base when lowering the deck to its low height position.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 53J is a similar view to FIG. 53I with the foot end of the lift assembly raised while the head end is raising;

DETAILED DESCRIPTION OF THE EMBODIMENTS

Figure 1:
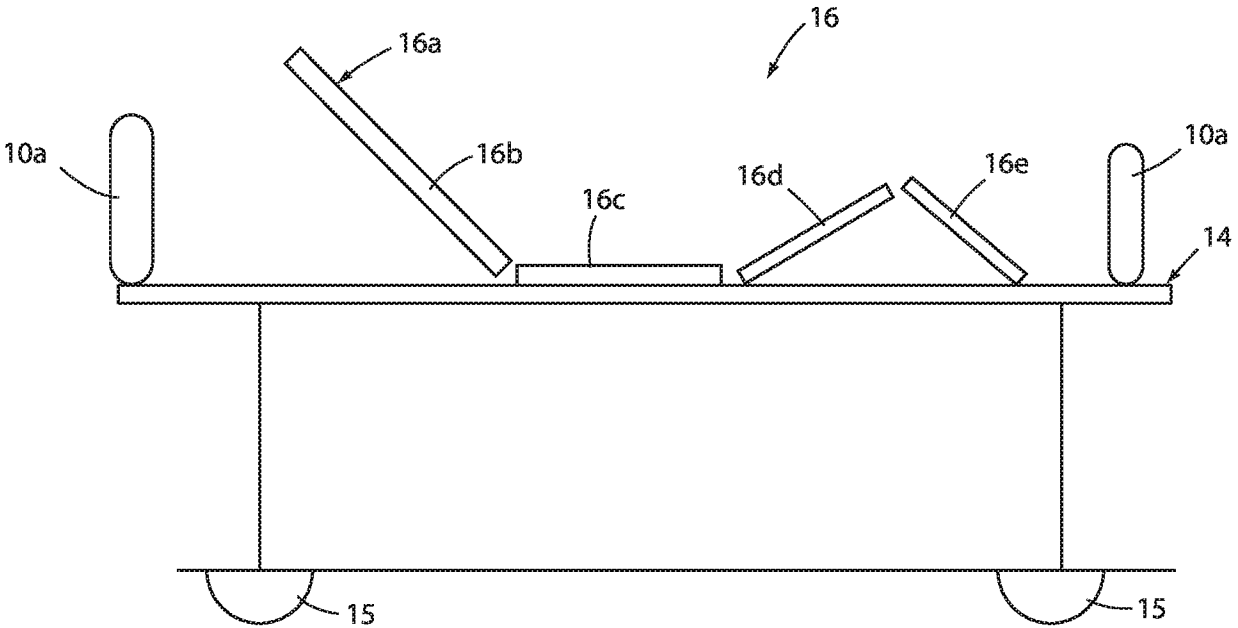
FIG. 1 is a perspective view of a patient support apparatus.

Referring to FIG. 1, the numeral 10 generally designates a patient support apparatus. In the illustrated embodiment, patient support apparatus 10 is a bed, such as a hospital bed, with head and foot boards 10*a*, 10*b*, side rails (not shown), and an articulating deck 16. However, it should be understood the patient support apparatus 10 may take on other forms, including a stretcher, a cot or the like. In general, patient support apparatus 10 is used whenever a patient is to be supported and it is desirable to raise and lower the patient relative to a floor surface or other supporting surface. As will be more fully described below, patient support apparatus 10 includes a lift assembly for raising and lowering the patient support apparatus surface, such as a mattress or other cushioning device, which supports a patient thereon, between a fully raised position and a lowermost position, while still leaving clearance sufficient to allow a base of an over bed table or a patient lift to be extended under the patient support apparatus.

Figure 2:
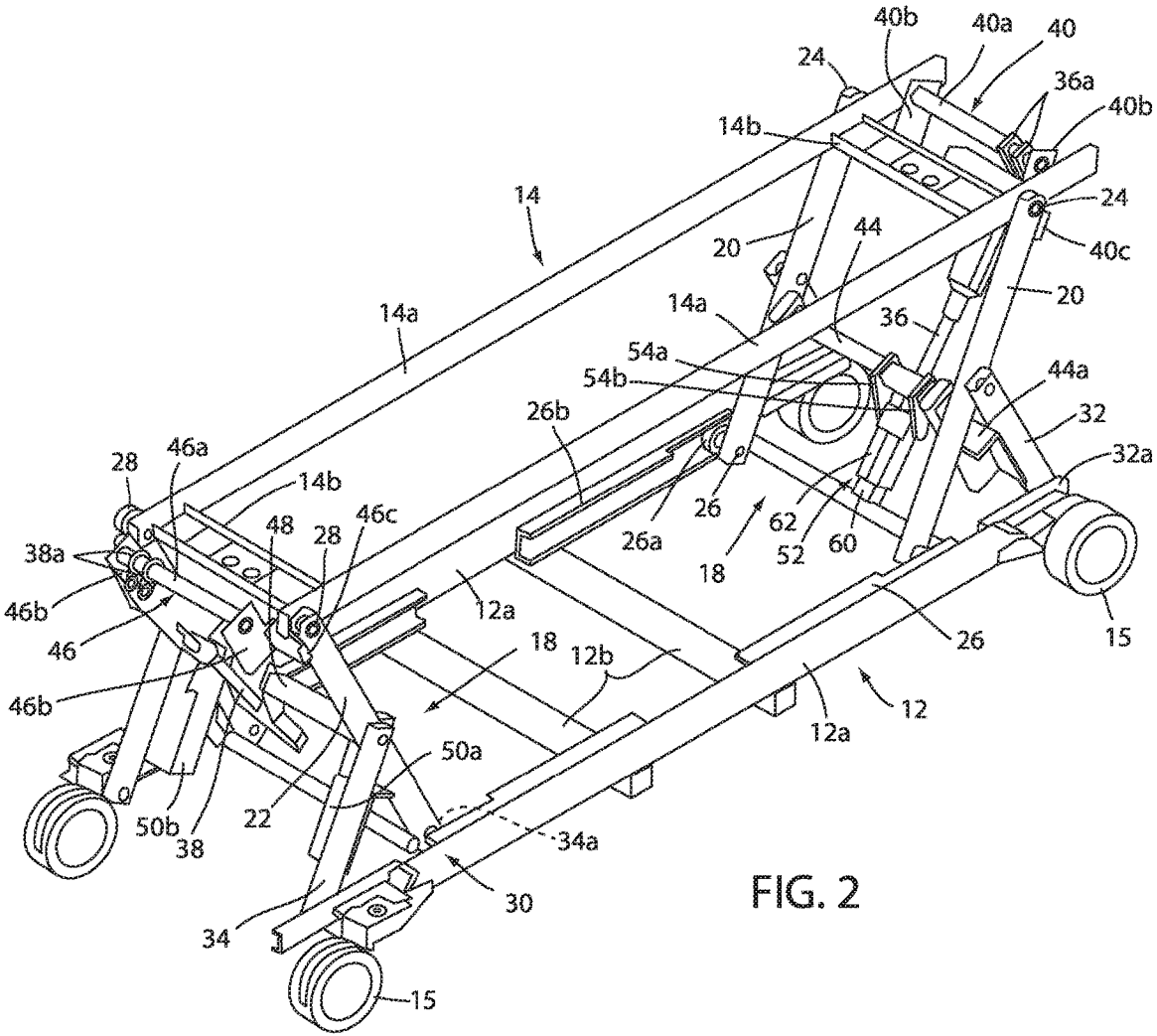
FIG. 2 is a perspective view of the patient support apparatus to FIG. 1 with the deck, headboard, and footboard removed to show the support frame in a full height position.

As best seen in FIG. 2, patient support apparatus 10 includes a base 12, a support frame 14 for supporting deck 16 (FIG. 1), and a lift assembly 18 for raising or lowering support frame 14 (and deck 16) relative to base 12. It should be understood that frame 14 may also support a load frame beneath deck 16, which is used for mounting sensors, such as load cells, to measure the weight of a patient supported on the deck.

Base 12 is a wheeled base with a plurality of caster wheels 15 to facilitate movement of the bed across a floor surface. In the illustrated embodiment, deck 16 includes a plurality of articulating deck sections 16*a*, 16*b*, 16*c*, 16*d*, and 16*e*. It should be understood, however, that the number of deck sections may vary. Each deck section may be articulated by an actuator (not shown) to raise or lower the deck sections, for example, to orient the deck sections in a flat configuration or in a chair configuration (and various other configurations in between). The construction of any of base 12, lift assembly 18, support frame 14, the headboard 10*a*, footboard 10*b*, and/or the side rails may take on any known designs, such as, for example, those disclosed in U.S. Pat. No. 7,690,059 issued to Lemire et al., and entitled HOSPITAL BED, commonly assigned to Stryker Corp., the complete disclosure of which is incorporated herein by reference herein in its entirety; or U.S. Pat. No. 8,689,376 entitled PATIENT HANDLING DEVICE INCLUDING LOCAL STATUS INDICATION, ONE-TOUCH FOWLER ANGLE ADJUSTMENT, AND POWER-ON ALARM CONFIGURATION, also commonly assigned to Stryker Corp., the complete disclosure of which is also hereby incorporated by reference herein in its entirety. The construction of any of base 12, lift assembly 18, support frame 14, the headboard 10*a*, footboard 10*b*, and/or the side rails may also take on forms different from what is disclosed in the aforementioned patent and patent publication.

Figure 3:
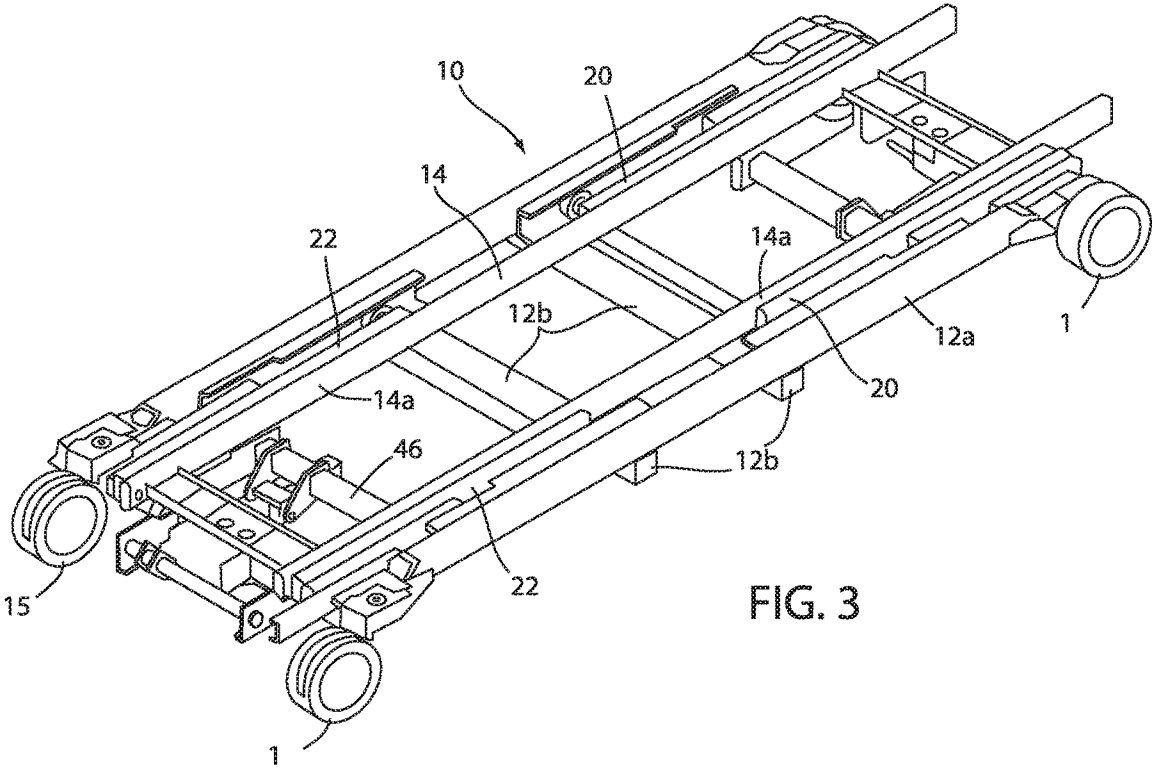
FIG. 3 is another perspective view of the patient support apparatus similar to FIG. 2 illustrating the support frame in a lowermost position.
Figure 4:
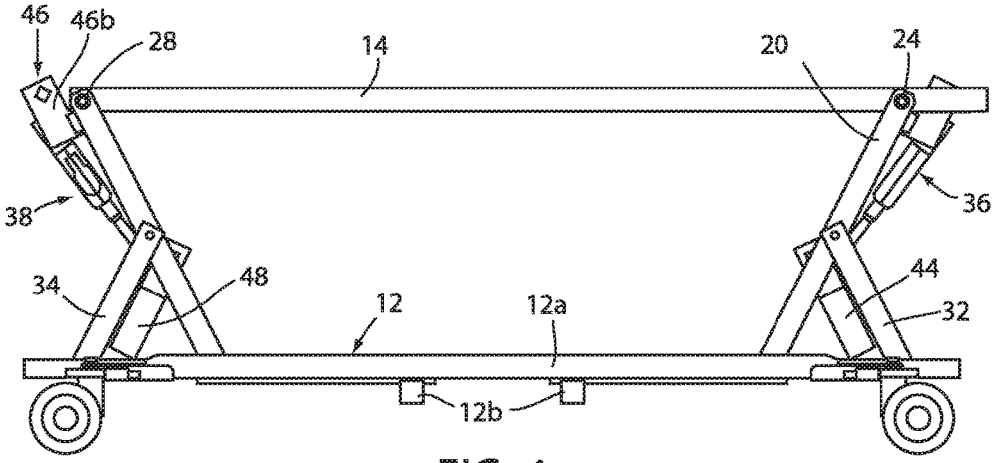
FIG. 4 is a side elevation view of the patient support apparatus in its full height configuration.

Lift assembly 18 is configured so that when lift assembly 18 is moved to its lowermost configuration lift assembly 18 may be substantially contained in or fully contained in base 12. Additionally, when lift assembly 18 is moved to its lowermost configuration, such as shown in FIG. 3, support frame 14 is also contained within base 12. As such, when lowered, patient support apparatus 10 may be configured so that the distance from the top of deck 16 to the supporting floor is less than 14 inches, less than 13 inches, and optionally less than 12 inches. In this manner, patient support apparatus 10 can provide a very low height patient support apparatus, which can reduce the chance of a patient fall.

Referring again to FIG. 2, lifting assembly 18 includes a pair of head end lifting legs 20 and a pair of foot end lifting legs 22. Head end lifting legs 20 are pivotally mounted at fixed pivot connections 24, such as pivot blocks, at their upper ends to support frame 14 and slidably pivotally mounted at sliding pivot connections 26 at their lower ends to base 12. In the illustrated embodiment, support frame 14 includes a pair of longitudinal frame members 14*a* and a pair of transverse frame members 14*b*, which connect longitudinal frame members 14*a* to form the frame. Head end lifting legs 22 are pivotally mounted at their upper ends to longitudinal frame members 14*a* adjacent their respective ends. Foot end lifting legs 22 are similarly mounted at their upper ends at fixed pivot connections 28, for example at pivot blocks, to support frame 14, namely to longitudinal frame members 14*a* adjacent their respective ends, and further slidably pivotally mounted at sliding pivot connections 30 at their lower ends to base 12. Furthermore, the lower ends of each pair of lifting legs are connected together by a transverse member 21, such as a rod, to thereby form a generally U-shaped leg assembly. In this manner, when lifting legs 20, 22 are folded relative to frame 14, pivot connections 26 and 30 (and hence the lower ends of lifting legs and their transverse members 21) will move inwardly towards the middle of base 12.

To move lifting legs 20, 22 between their fully extended configuration, such as shown in FIG. 2, and their lowermost configuration, such as shown in FIG. 3, each leg 20, 22 includes a lever, such as crank arm 32 and 34, respectively, which are coupled to actuators 36, 38. Crank arms 32 form head end crank arms, while crank arms 34 form foot end crank arms. Similarly actuator 36 forms a head end actuator, while actuator 38 forms a foot end actuator. Each crank arm 32, 34 is pivotally mounted at its upper end to a respective lifting leg, and furthermore optionally pivotally mounted to a medial portion of its respective lifting leg. Upper end of head end actuator 36 is mounted to the upper end of head end lifting legs 20, for example, by a transverse mount 40, which is offset from the upper ends of lifting legs 20 so that when actuator 36 is extended, the force from the actuator will apply a moment to the lifting legs. The lower end of head end actuator 36 is similarly coupled to the head end crank arms 32 by way of a cross-member 44, which is mounted to the respective head end crank arms by brackets 44*a*, 44*b*. Similarly the upper end of actuator 38 is mounted to the upper ends of lifting legs 22 by way of transverse mount 46, which is offset from lifting legs 22. In this manner, when actuator 38 is extended, the force from actuator 38 will apply a moment to lifting legs 22. The lower end of foot end actuator 38 is then coupled to the foot end crank arms 34 by way of a cross-member 48, which is mounted to the respective foot end crank arms 34 by brackets 50*a* and 50*b*. In this manner when actuators 36 and 38 extend or contract to push or pull on cross-members 40, 44, 46 and 48, lifting legs 20, 22 will raise or lower frame 14.

For example, brackets 44*a*, 44*b*, 50*a* and 50*b* may be formed from angle members, with one leg of the angle member joined, for example, by welding to the respective cross-members (44, 48) and the other leg joined, for example, by welding to the respective crank arm (32, 34).

In the illustrated embodiment, transverse mounts 40, 46 have a V-shaped configuration with horizontal transverse members 40*a*, 46*a*, which provide the mounting surface for the respective actuator and a pair of arms 40*b*, 46*b*, which are mounted to the opposed ends of the respective transverse member (40*a*, 46*a*). Arms 40*b*, 46*b* are then mounted to the upper ends of lifting legs 20, 22 by way of laterally extending brackets 40*c*, 46*c*, which are joined with the respective legs, for example by welding. In the illustrated embodiment, brackets 40*c*, 46*c* are formed from bars, though it should be understood that other forms may be used, such tubular members.

Similarly each transverse member 40*a*, 46*a* may be formed from a solid member, such as bar or a tubular member. In the illustrated embodiment, transverse members 40*a*, 46*a* are formed from a non-circular bar or rod. Arms 40*b*, 46*b* may be formed from plates or channels, which as noted, are joined with the ends of the respective transverse member, for example by welding. The upper ends of the actuators are mounted to the transverse members 40*a*, 46*a* by a pair of plate brackets 36*a* 38*a*, which have non-circular openings to receive the non-circular bar or rod so that brackets 36*a*, 38*a* can apply a moment to each transverse member 40*a*, 46*a* when the actuator is extended or retracted.

Figure 7:
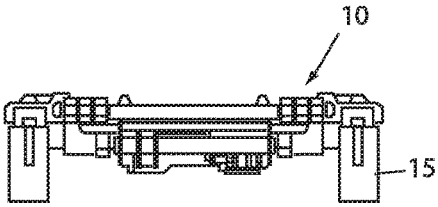
FIG. 7 is an end elevation view of the patient support apparatus of FIG. 5.
Figure 7A:
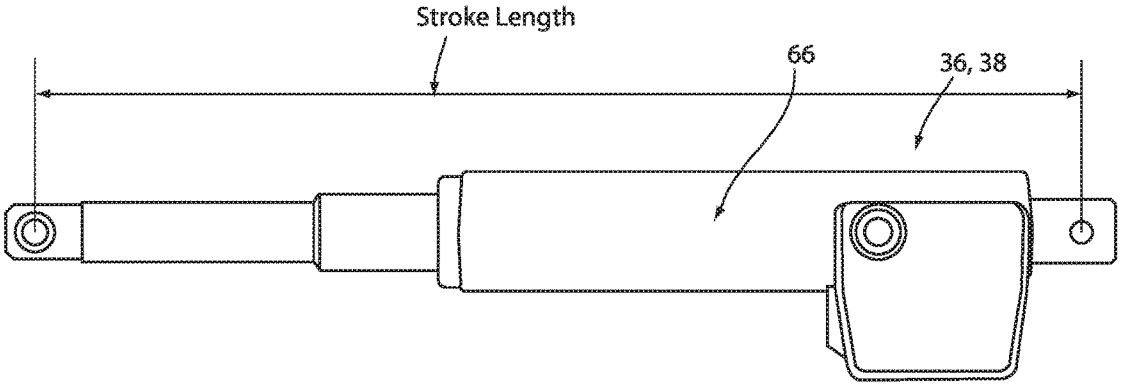
FIG. 7A is an enlarged side view of the actuator with the offset mount removed.
Figure 7B:
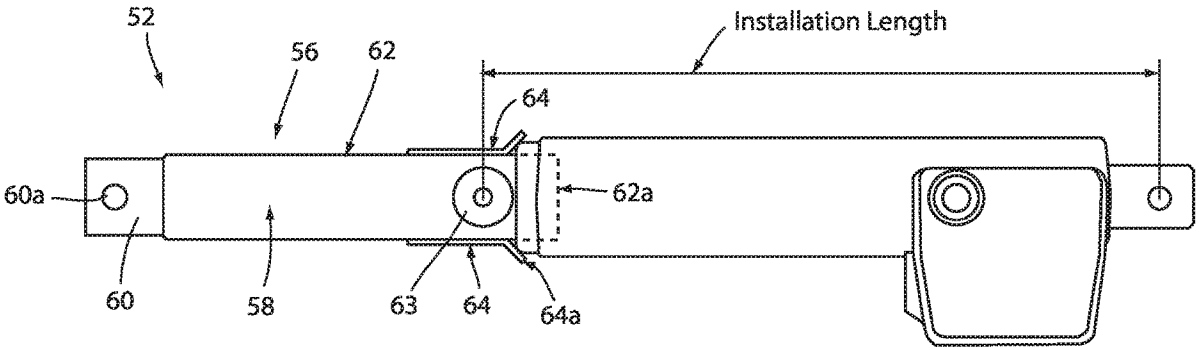
FIG. 7B is a similar view to FIG. 7A illustrating the offset mount attach to the actuator.
Figure 8:
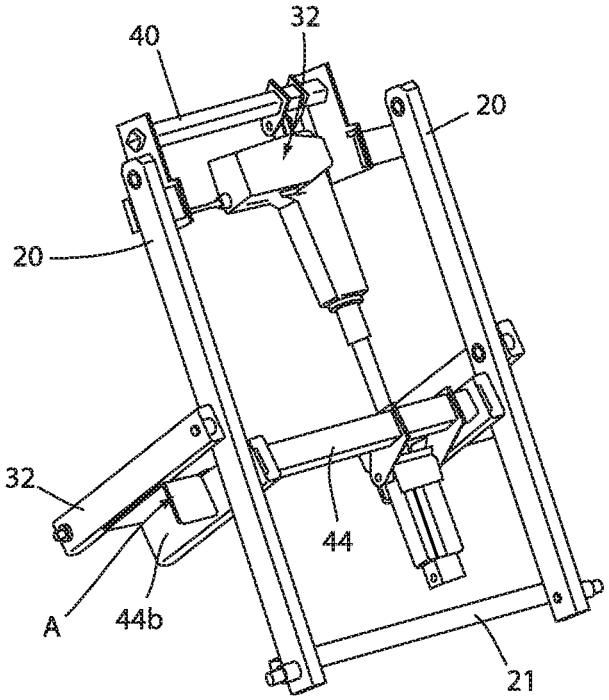
FIG. 8 is a perspective view of the lifting assembly of FIGS. 4 through 7 with the deck, frame, and base removed to show the lifting assembly in a fully extended configuration.
Figure 9:
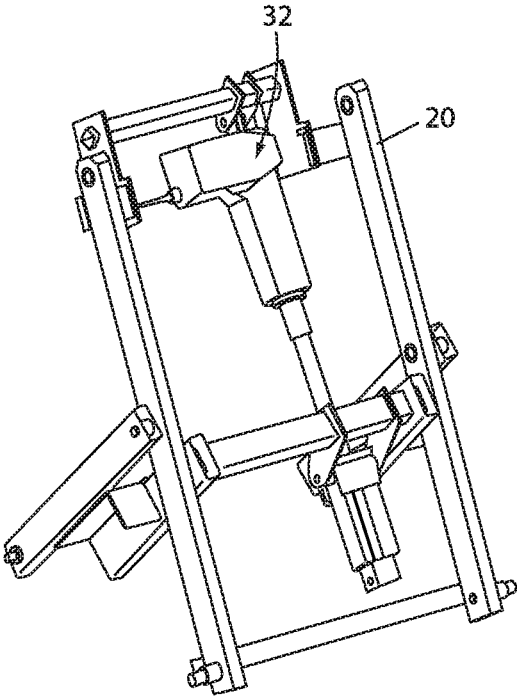
FIG. 9 is a similar view to FIG. 8 with the lifting assembly in a lowered configuration.
Figure 10:
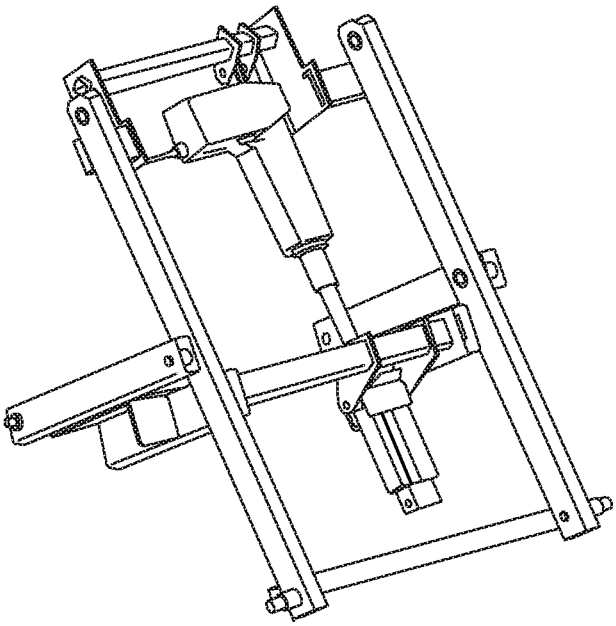
FIG. 10 is a similar view to FIG. 9 with the lift assembly in another lowered configuration.
Figure 11:
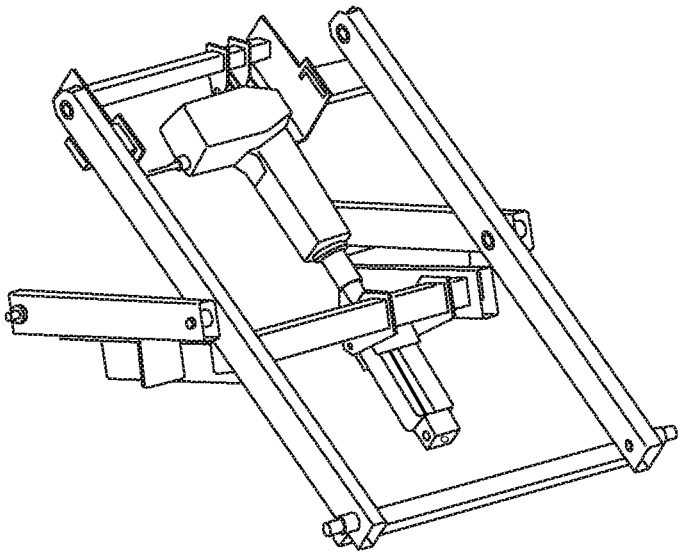
FIG. 11 is a similar view to FIG. 10 with the lift assembly in another lowered configuration.
Figure 12:
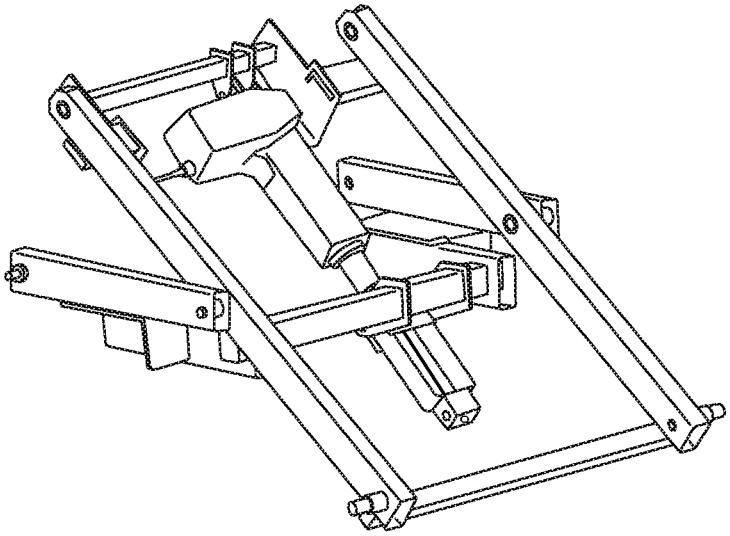
FIG. 12 is a similar view to FIG. 11 with the lift assembly in another lowered configuration.
Figure 13:
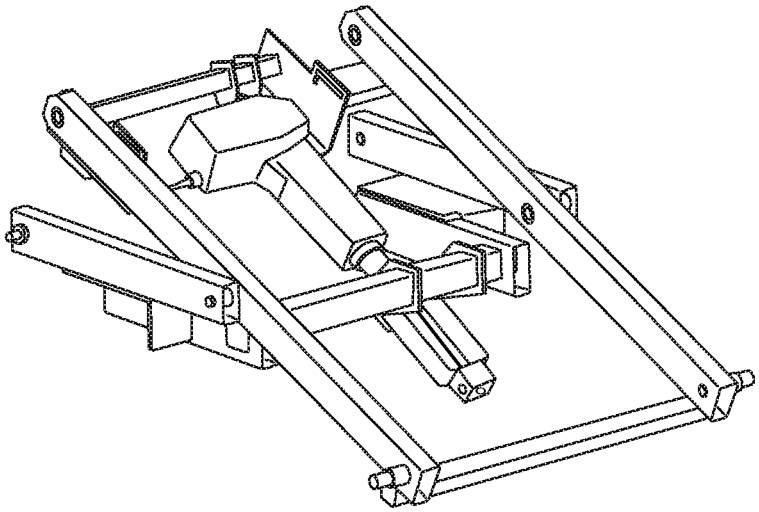
FIG. 13 is a similar view to FIG. 12 with the lift assembly in another lowered configuration.
Figure 14:
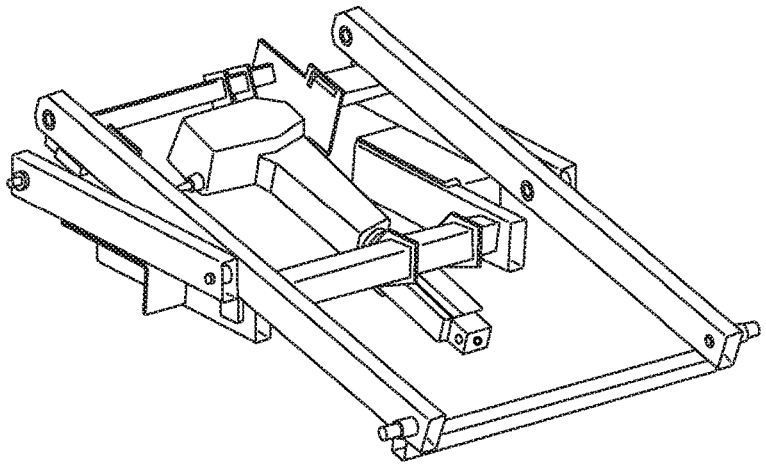
FIG. 14 is a similar view to FIG. 13 with the lift assembly in another lowered configuration.
Figure 15:
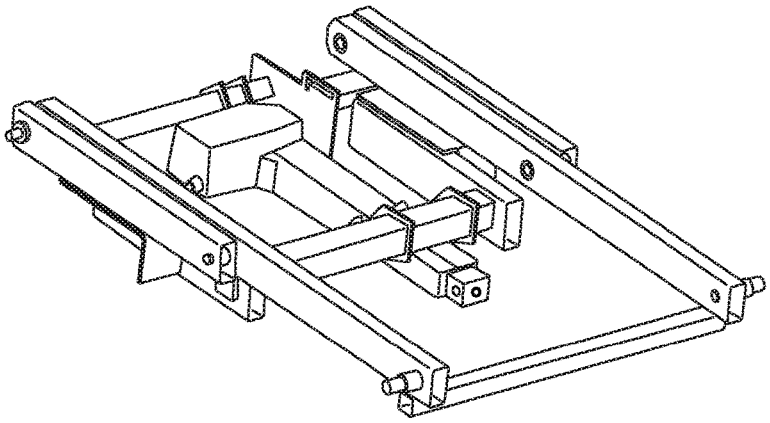
FIG. 15 is a similar view to FIG. 14 with the lift assembly in a lowermost configuration.
Figure 16:
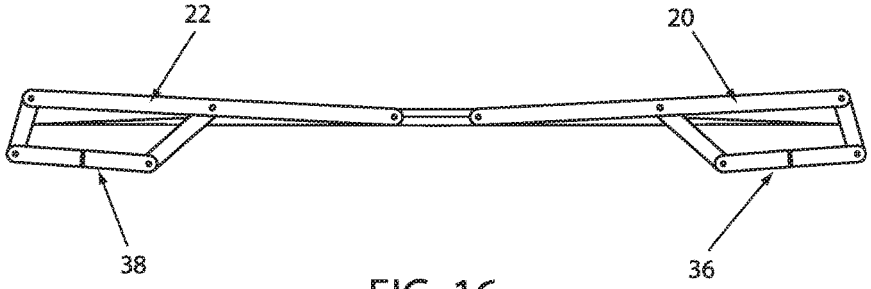
FIG. 16 is a schematic side elevation view of the lift assembly and the base with the lift assembly in its lowermost configuration.
Figure 17:
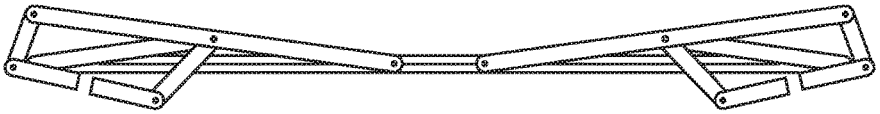
FIG. 17 is a similar view to FIG. 16 with the lift assembly extended.
Figure 18:
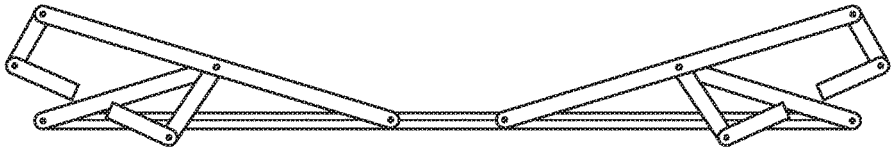
FIG. 18 is a similar view to FIG. 17 with the lift assembly extended.
Figure 19:
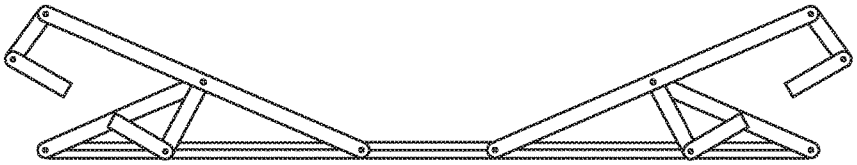
FIG. 19 is a similar view to FIG. 18 with the lift assembly extended.
Figure 20:
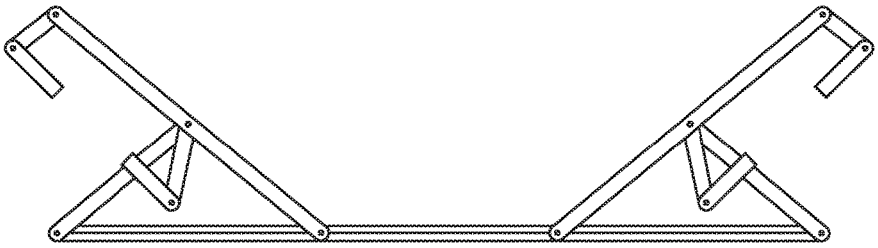
FIG. 20 is a similar view to FIG. 18 with the lift assembly extended.
Figure 21:
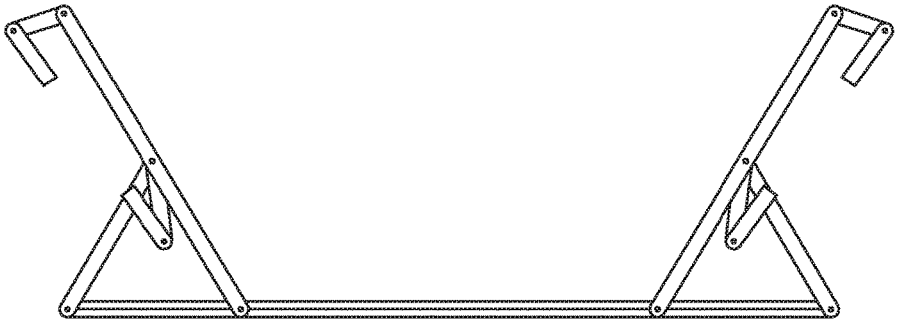
FIG. 21 is a similar view to FIG. 18 with the lift assembly extended.
Figure 22:
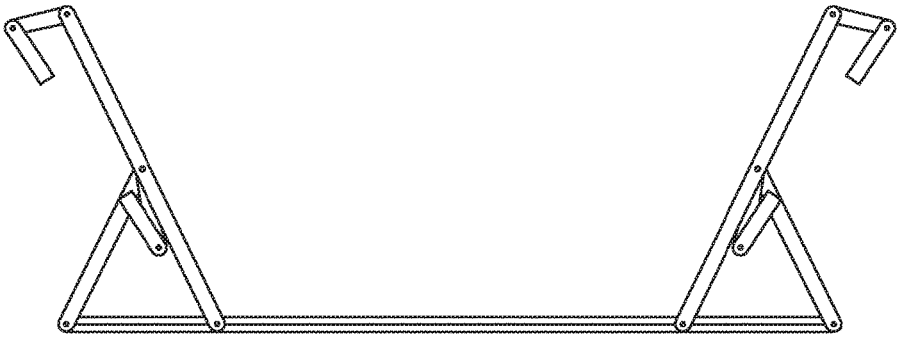
FIG. 22 is a similar view to FIG. 18 with the lift assembly extended to its full height configuration.

Similarly, as noted, the lower ends of actuators 36, 38 are mounted to cross-members 44 and 48 by mounts 52. Referring to FIGS. 7A and 7B, mounts 52 mount the actuators so that their installed lengths are less than the stroke length of the actuators. In this manner, the actuators can be extended to their fully extended and fully retracted lengths but have an effective, installed length that is always less than the actuator length.

Referring to FIG. 2, each mount 52 includes a pair of mounting brackets 54*a*, 54*b*. In the illustrated embodiment, mounting brackets 54*a*, 54*b* are formed from plate brackets with non-circular openings to receive cross-members 44, 46 which have non-circular cross-sections (e.g. square tubular members) so that the brackets can apply moments to the cross-members when the actuators extend or contract. Brackets 54*a*, 54*b* may, therefore, be simply mounted on the cross-members, but also may be welded to the cross-members.

Referring to FIGS. 7A and 7B, mounts 52 also include a frame structure 56 that provides an offset mounting arrangement so that the lower ends of the actuators are offset from the attachment point of the brackets 54*a*, 54*b* to the cross-members. In the illustrated embodiment, each frame structure 56 includes a U-shaped member 58 with a U-shaped bracket 60 at one end for pivotally mounting to the distal end of the extendible rod of the actuator at a pivot connection 60*a*. U-shaped member 58 includes a pair of spaced apart mounting webs or arms 62, which support pivot connections 63 (formed such as by pins and bushings) for pivotally mounting the end of the actuator to mounting brackets 54*a*, 54*b*. To reinforce arms 62, arms 62 are joined by a pair of reinforcing plates 64, which together form a box. Arms 62 and plates 64 may each include angled ends 62*a*, 64*a* (FIG. 7B) that may contact and provide bearing surfaces for the actuators.

In the illustrated embodiment, each actuator 36, 38 includes a body 66 and extendable member 68, such as an electric, pneumatic, or hydraulic cylinder, which define a stroke length as measured from their proximate end to their distal end (distal end of extendible member). Angled ends 62*a*, 64*a* are may be positioned so that they contact and bear against the bodies of the actuators. As would be understood, frame structure 62, therefore, moves the mounting point of the actuators from their distal ends to a location offset inward along the longitudinal axis (stoke axis) of the actuator so that the installed length is less that the stroke length the actuator.

Figure 5:
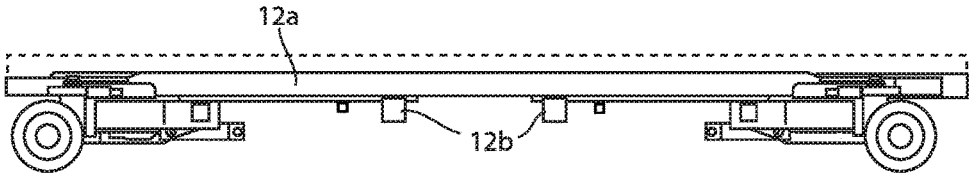
FIG. 5 is a side elevation view of the patient support apparatus with the support frame in its lowermost position.
Figure 6:
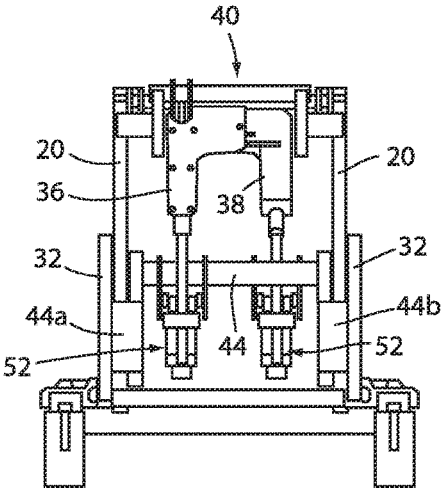
FIG. 6 is an end elevation view of the patient support apparatus of FIG. 4.

As noted above, the lower ends of lifting legs 20, 22 are mounted to base 12 by sliding pivot connections 26. As best seen in FIG. 2, pivot connections 26 are formed by wheels 26*a* mounted to the lower ends of the lifting legs and which are guided in channels 26*b*, which in turn are mounted to base 12. To make the lifting assembly more compact, channels 26*b* may be mounted to the inwardly facing sides of longitudinal base members 12*a* of base 12. Similarly, crank arms 32, 34 are pivotally mounted at their lower ends at fixed pivot connections 32*a*, 34*a* mounted to the inwardly facing side of base members 12*a*. In this manner, when lifting legs 20, 22 and crank arms 32, 34 are folded, wheels 26*a* will move along channels 26*b* inwardly toward the middle of base 12. Further, legs 20, 22 and crank arms 32, 34 will fold so that they lie in a plane defined by base members 12*a* and, further, so that they lie between an upper boundary and a lower boundary defined by members 12*a* (FIGS. 3 and 5).

When frame 14 is in its lowermost position (FIG. 3), frame members 14*a* of frame 14 are also aligned in base 12 between base members 12*a*. Further, frame members 14*a* are located between the upper and lower boundaries defined by base members 12*a* and generally aligned in the same plane as lifting legs 20, 22 and crank arms 32, 34. As a result, the fixed pivot connections and sliding pivot connections will all lie in the same plane.

Optionally, base members 12*a* are reinforced by transverse members 12*b*, which are joined with the underside of base members 12*a* for example, by welding. For example, suitable transverse members 12*b* include tubular members (as shown), angle members, channel members or the like. In this manner, when lift assembly 18 is in its lowermost configuration, many of the components of the lift assembly (lifting legs, crank arms) are lowered into the space defined between base members 12*a* and above transverse members 12*b*. Additionally, when lift assembly 18 is in its lowermost configuration, the distance from the top of the deck (shown in FIG. 1) to the floor may be less than 14", less than 13", and optionally less than 12".

Referring again to FIG. 5, when the lowermost position, actuators 36, 38 of lift assembly 18 lie beneath base members 12*a* but are spaced at opposed ends of base 12 so that they do not interfere with the space below base 12, at least in the medial portion of base 12. Further, actuators 36, 38 lie in a plane below but parallel to the plane defined by base members 12*a*, which provides actuator 36, 38 leverage to raise lifting legs 20, 22 even when in their lowermost positions. Further, the space below base members 12*a* and between transverse members 12*b* of base 12 is sufficient to allow a base of an overbed table or lift assembly to extend under base. For example, the distance from the underside of the base members 12*a* to the floor is at least 4", at least 5" or between about 5"-6".

Referring to FIGS. 8-15, the motion of lift assembly 18 is shown in reference to one of the lifting leg assemblies, starting from the fully raised position where the actuator is fully extended. In the fully extended position, legs 20 and crank arms 32 form a Y-shaped configuration, with the angle A between crank arms 32 and the lower end of legs 20 forming an acute angle of about 45 degrees to 60 degrees. As actuator 36 contracts and pulls on transverse member 40 and on cross-member 44, the lower ends of legs 20 move away from the fixed pivot connections 32*a* of crank arms 32, and angle A increases until it becomes obtuse, and further about 180 degrees, where legs 20 lie in the same plane as crank arms 32 (see FIG. 15).

FIGS. 16-22 provide simplified, schematic illustrations of the movement and how the forces of actuators 36, 38 are applied to the lifting legs 20, 22. Further, with this configuration, lift assembly 18 can achieve a full range of motion from a very low height to a fully raised position with a fairly low actuator force, for example, less than 8000 N.

As would be understood, because the head end and foot end lifting legs are independent, they can be independently moved to raise or lower the head or foot ends of the support frame to move the deck in a Trendelenburg or reverse Trendelenburg position. Additionally, the speeds of each actuator can be independently controlled. For example, suitable actuators include Linak actuators, such as model number LA 40, or Ilcon actuators. For example, the actuators may include sensors or magnets to measure the speed of the actuator so that, as noted, the actuation and speed of each actuator may be independently installed.

Figure 23:
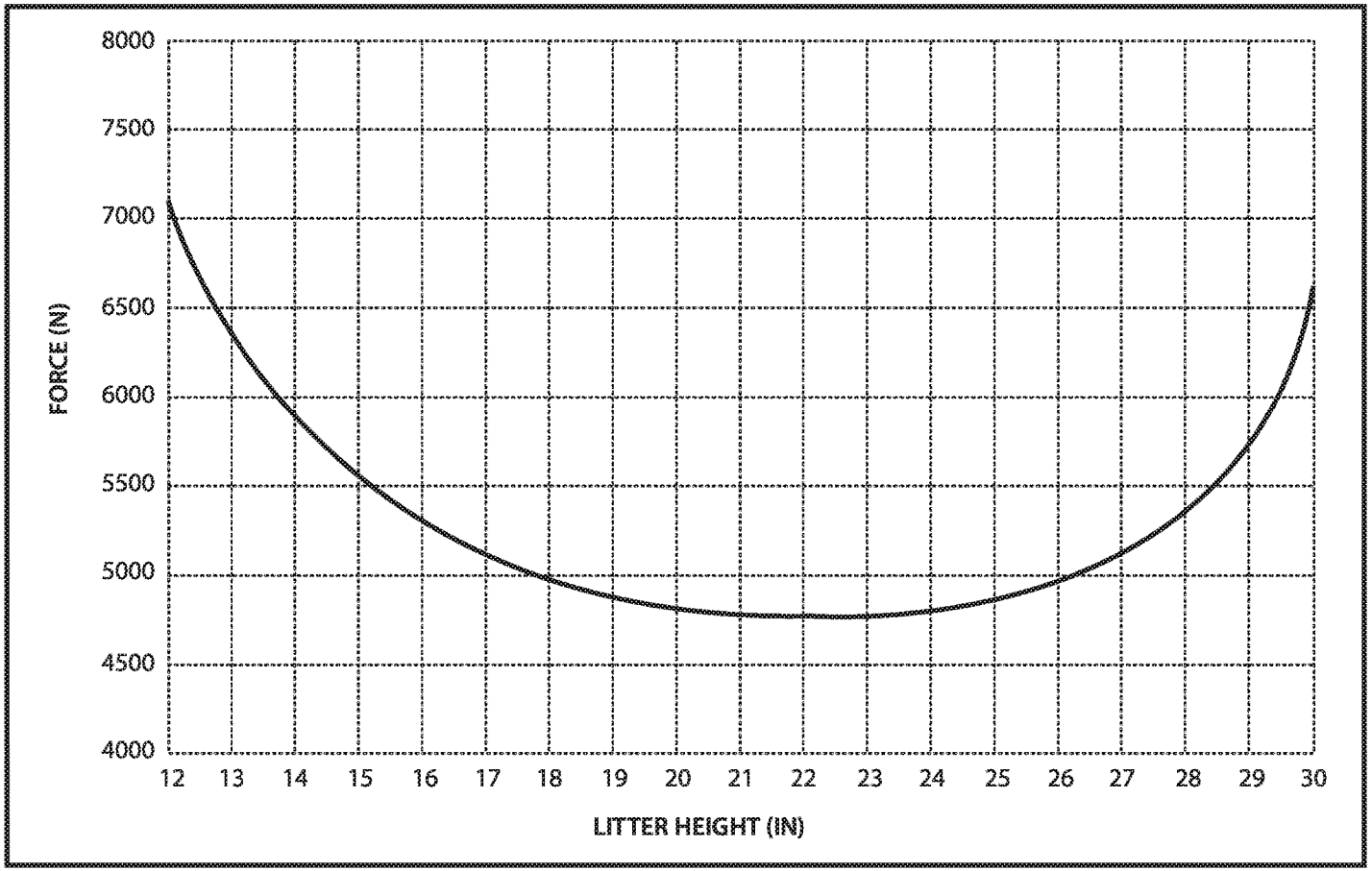
FIG. 23 is a graph illustrating the force versus height over the full range of motion of the lift assembly.

Referring to FIG. 23, the force of the actuator ranges from about 7100 N when in the lowermost position to about 4750 N when about midway between the lowermost position and then back up to about 5540 N when in the uppermost position. As would be understood the greatest force is needed when the lift assembly is in its most compact, lowermost position when the only leverage is the offset provided by transverse member 40 and mount 52. As the lifting legs raise up relative to the base, the leverage provided by the crank arms increases until the lift assembly has reached the midway region, approximately 19-24 inches off the floor, at which point the leverage provided by the crank arms reduces at an increasing rate, as shown in FIG. 23, until the lift assembly is in its uppermost configuration.

Figure 24:
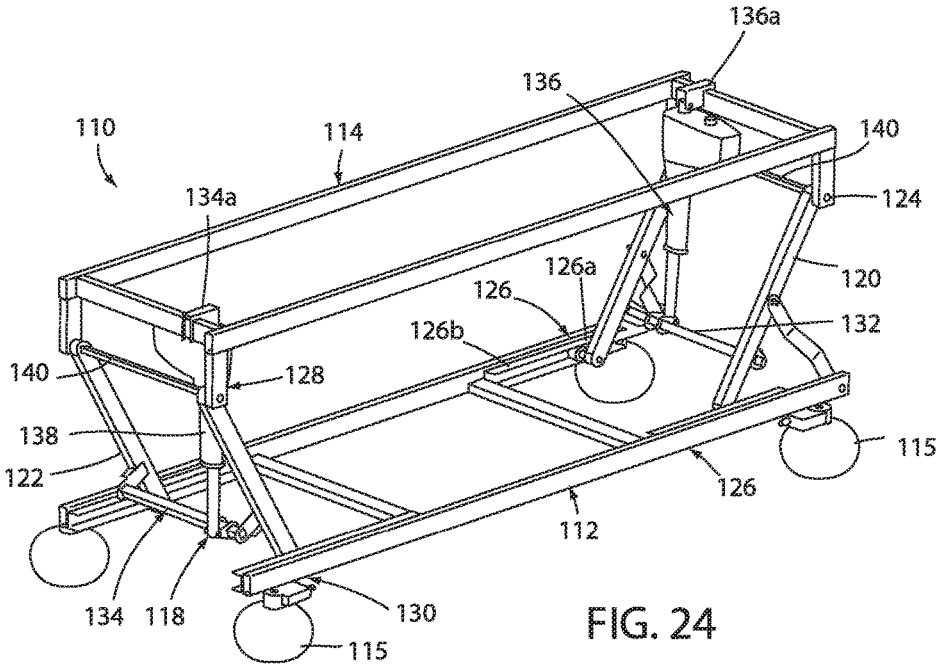
FIG. 24 is a perspective view of a second embodiment of the patient support apparatus.
Figure 25:
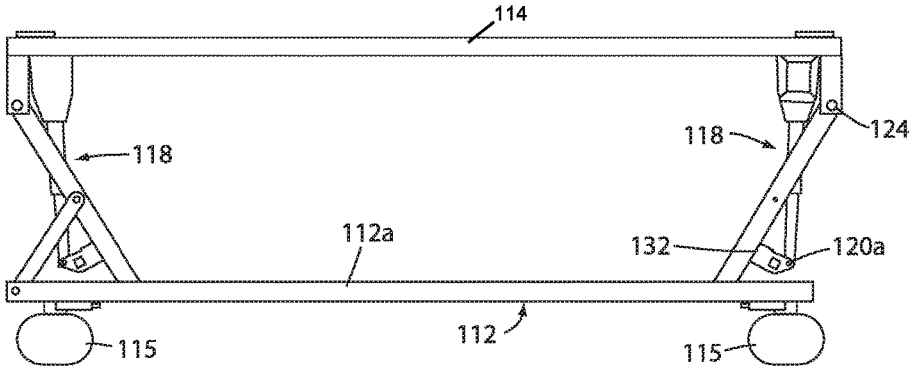
FIG. 25 is a side elevation view of the patient support apparatus of FIG. 24.
Figure 26:
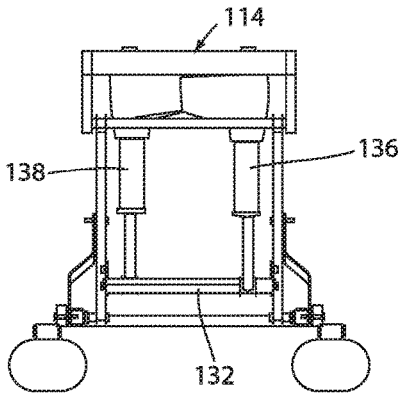
FIG. 26 is an end elevation view of the patient support apparatus of FIG. 24.
Figure 27:
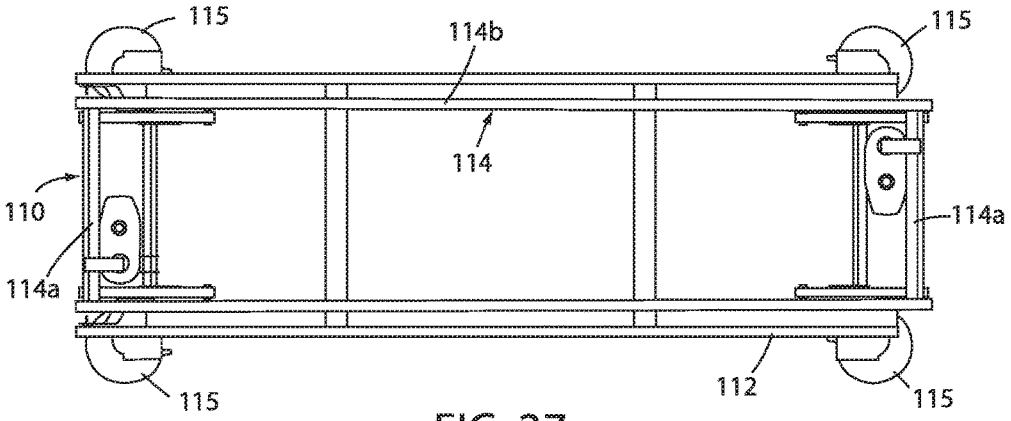
FIG. 27 is a top plan view of the patient support apparatus of FIG. 25.

Referring to FIG. 24, the numeral 110 generally designates another embodiment of a patient support apparatus. Patient support apparatus 110 may also form a bed, such as a hospital bed, but is only illustrated with the deck, mattress, side rails, headboard and footboard removed for clarity. However, it should be understood the patient support apparatus 110 may also take on other forms, including a stretcher, a cot, or the like. In general, patient support apparatus 110 is used whenever a patient is to be supported and it is desirable to raise and lower the patient relative to a floor or other supporting surface. Similar to patient support apparatus 10, patient support apparatus 110 includes a lift assembly 118 for raising and lowering the patient support apparatus surface, such as a mattress or other cushioning device, which supports a patient thereon, between a fully raised position and a lowermost position, while still leaving clearance sufficient to allow a base of an over bed table or a patient lift to be extended under the patient support apparatus.

Figure 28:
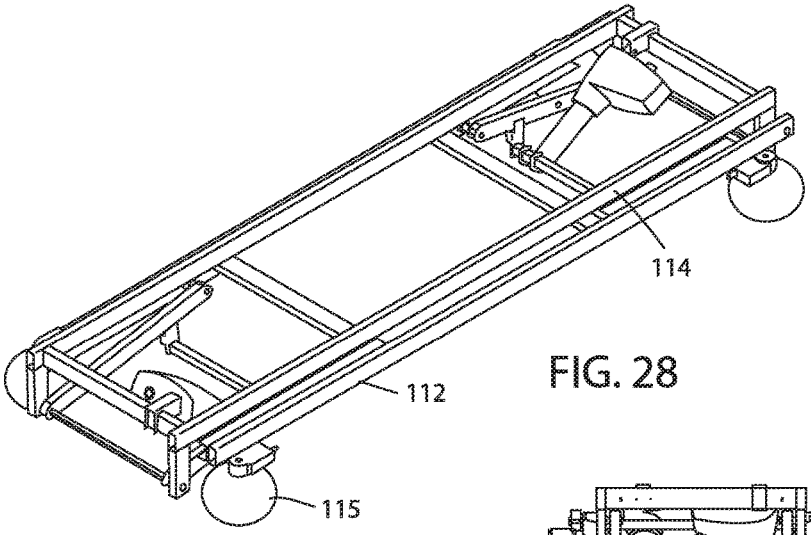
FIG. 28 is a perspective view of the patient support apparatus of FIG. 24 illustrated in the lowermost position.

As best seen in FIG. 24, patient support apparatus 110 includes a base 112, a support frame 114 for supporting a deck (not shown), and a lift assembly 118 for raising or lowering support frame 114 (and the deck) relative to base 112. In the illustrated embodiment, base 112 is also a wheeled base with a plurality of caster wheels 115. Lift assembly 118 is configured so that when lift assembly 118 is moved to its lowermost configuration lift assembly 118, the lift assembly may be substantially contained in or fully contained in base 112. Additionally, when lift assembly 118 is moved to its lowermost configuration, such as shown in FIG. 28, support frame 114 is lowered so that at least the attachment points to the lift assembly are also contained within base 112. As such, when lowered, patient support apparatus 110 may be configured so that the distance from the top of the deck to the supporting floor is less than 14 inches, less than 13 inches, and optionally less than 12 inches. In this manner, patient support apparatus 110 can provide a very low height patient support apparatus, which can reduce the chance of a patient fall.

Referring again to FIG. 24, lifting assembly 118 includes a pair of head end lifting legs 120 and a pair of foot end lifting legs 122. Head end lifting legs 120 are pivotally mounted at their upper ends at fixed pivot connections 124 to support frame 114 and slidably pivotally mounted at sliding pivot connections 126 at their lower ends to base 112. Foot end lifting legs 122 are similar similarly mounted at fixed pivot connections 128 to support frame 114 and slidably pivotally mounted at sliding pivot connections 130 at their lower ends to base 112. In the illustrated embodiment, frame 114 includes longitudinal frame members **114*b* and downwardly depending frame members 114*c*, which depend downwardly from members 114*b*, with fixed pivot connections 124 mounted to the ends of downwardly depending frame members 114*c*. The downwardly depending frame members 114*c*** reduce the length of the cranks so that space used for lift assembly can be reduced.

In this manner, when actuators 136, 138 are extended, they will lift frame 114 (and hence the deck) and rotate the cranks to move the lifting legs 120, 122 along their sliding pivot connections to where they are almost vertical. When actuators 136, 138 are retracted, they will pull on frame 114 (and hence the deck) and rotate the cranks to move the lifting legs 120, 122 along their sliding pivot connection inward towards the middle of base 112 and fold relative to frame 114 and base 112. The upper ends of both pairs of legs may be joined or connected by a transverse member 140 to thereby form an inverted U-shaped leg assembly.

To move lifting legs 120, 122 between their fully extended configuration, such as shown in FIGS. 24-27, and their lowermost configuration, such as shown in FIG. 28-33, each leg 120, 122 includes a lever or crank 132 and 134, respectively, which are coupled to actuators 136, 138. Crank 132 forms a head end crank, while crank 134 forms a foot end crank. Similarly actuator 136 forms a head end actuator, while actuator 138 forms a foot end actuator.

Each crank 132, 134 has generally C-shaped configuration with a transverse member and two projecting arms that are fixedly mounted to a pair of respective lifting legs, and furthermore optionally mounted to a lower portion of its respective pair lifting legs. The upper end of head end actuator 136 is mounted to frame 114, for example, by a pair of brackets **136*a*, and optionally directly to the transverse frame member 114*a* at the head end of the frame 114. The lower end of head end actuator 136 is similarly coupled to crank 132. Therefore, when actuator 136 is extended, the force from the actuator will apply a lift force to the support frame and a moment on head end lifting legs 120 to thereby cause sliding pivot connections 126 to move outwardly along base 112 and cause legs 120 to straighten. Similarly, the upper end of foot end actuator 138 is mounted to frame 114 by way of brackets 138*a*, and optionally directly to the transverse frame member 114*a* at the foot end of the frame 114. The lower end of foot end actuator 138 is then coupled to the foot end crank 134. Again, when actuator 138 is extended, the force from actuator 138 will apply a lifting force to frame 114 and a moment to lifting legs 122. In this manner, when actuators 136 and 138 extend or contract to push or pull on frame 114 and cranks 132 and 134, lifting legs 120, 122 will raise or lower frame 114**.

In the illustrated embodiment, head end lifting legs 120 also include arms **120*a*, which are pivotally mounted at fixed pivot connections at their upper ends to legs 120 and pivotally mounted at their lower ends at fixed pivot connections to base 112. Arms 120*a* have inwardly offset portions to accommodate the inwardly offset of legs 120, which are mounted by sliding pivot connections to the inside of base 112**, similar to the previous embodiment.

Figure 29:
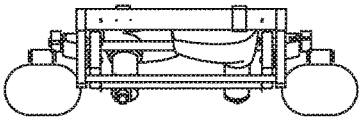
FIG. 29 is an end elevation view of the patient support apparatus of FIG. 28.
Figure 30:
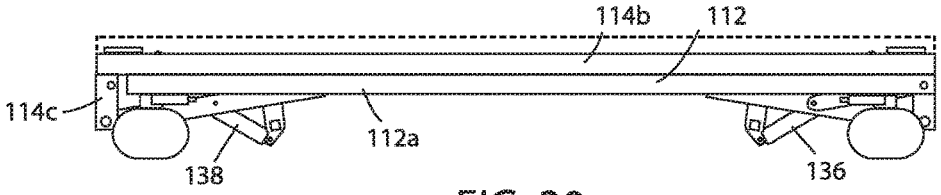
FIG. 30 is a side elevation view of the patient support apparatus of FIG. 28.
Figure 31:
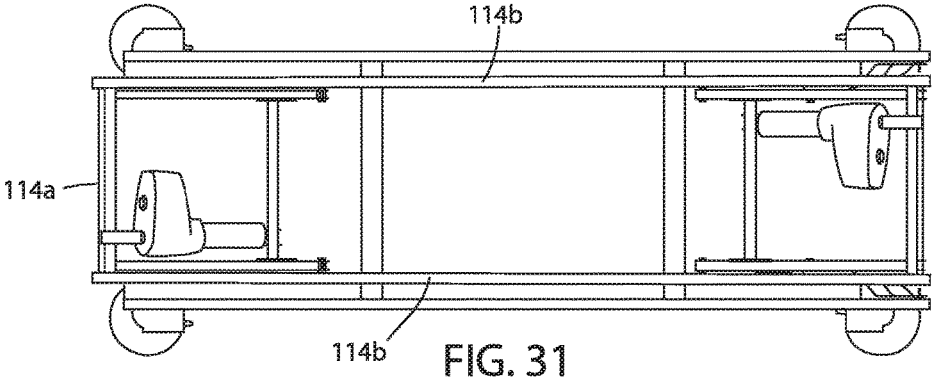
FIG. 31 is a plan view of the patient support apparatus of FIG. 30.

As best seen in FIG. 24, pivot connections 126 are formed by wheels **126*a* mounted at the lower ends of the legs and guided in channels 126*b*, which in turn are mounted to base 112. To make the lifting assembly more compact, channels 26***b* may be mounted to the inwardly facing sides of longitudinal base members 112*a* of base 112. Similarly, arms 120*a* are pivotally mounted at their lower ends at fixed pivot connections mounted to the inwardly facing side of base members 112*a*. In this manner, when lifting legs 120, 122, and arms 120*a* are folded, wheels 126*a* will move along channels 126*b* inwardly toward the middle of base 12. Further, legs 120, 122 and arms 120*a* will fold so that they lie in the plane defined by base members 112*a* and further so that they lie between an upper boundary and a lower boundary defined by members 112*a* (FIG. 29).

When frame 114 is in its lowermost position (FIGS. 29 and 30), longitudinal frame members 114*b* of frame 114 are lowered onto base 112 over base members 112*a*. Further, frame members 114*c* straddle base 112 and extend below base members 112*a* but are inward of caster wheels 115. Additionally, the actuators extend below base members 112*a* (at least the rod end) so that they still retain leverage to raise the lifting legs when even in their lowermost position.

Optionally, base members 112*a* are reinforced by transverse members 112*b*, which are joined with the underside of base members 112*a* for example, by welding. For example, suitable transverse members 112*b* include tubular members (as shown), angle members, channel members or the like. When lift assembly 118 is in its lowermost configuration, all of the head end lift assembly components are lowered into the space defined by base members 112*a*, transverse members 112*b*, and the head end of base 112. Similarly, when lift assembly 118 is in its lowermost configuration, all of the foot end lift assembly components are lowered into the space defined by base members 112*a*, transverse members 112*b*, and the foot end of base 112. In this manner, when lift assembly 118 is in its lowermost position, the distance from the top of the litter deck (shown in phantom in FIG. 30) to the floor may be less than 14", less than 13", and optionally less than 12", and the space beneath base members 112*a* is unobstructed to allow a base of an overbed table or lift assembly to extend under base. For example, the distance from the underside of the base members 112*a* to the floor is at least 4", at least 5" or between about 5"-6". Further, when lift assembly is in its raised position, the lifting legs move outwardly toward the ends of the frame to thereby leave a space sufficient to allow a fluoroscope device to extend between the frame and the base.

Figure 32:
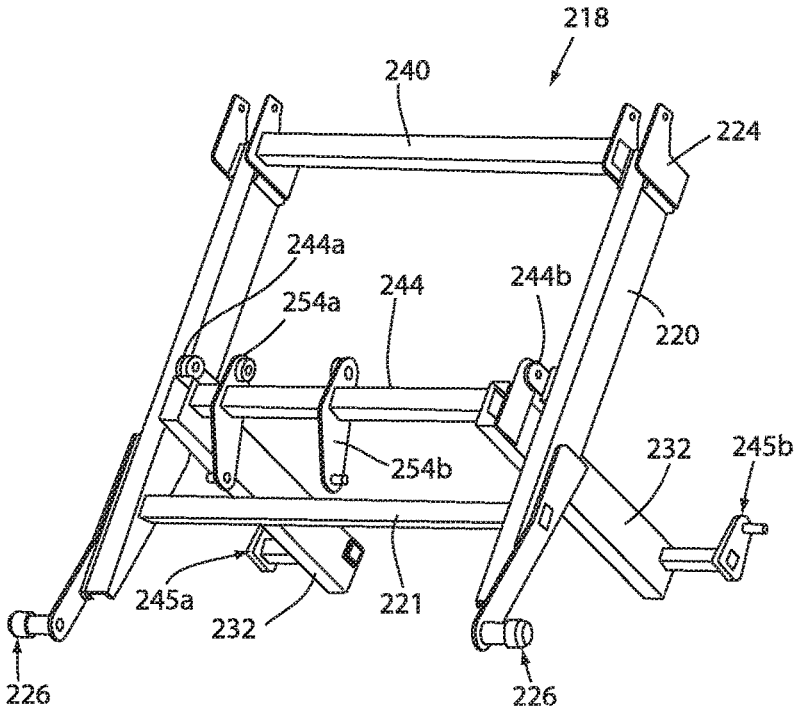
FIG. 32 is a perspective view of a head end portion of the lift assembly of another embodiment with several components removed to show the structure of the lifting legs and crank arms.
Figure 33:
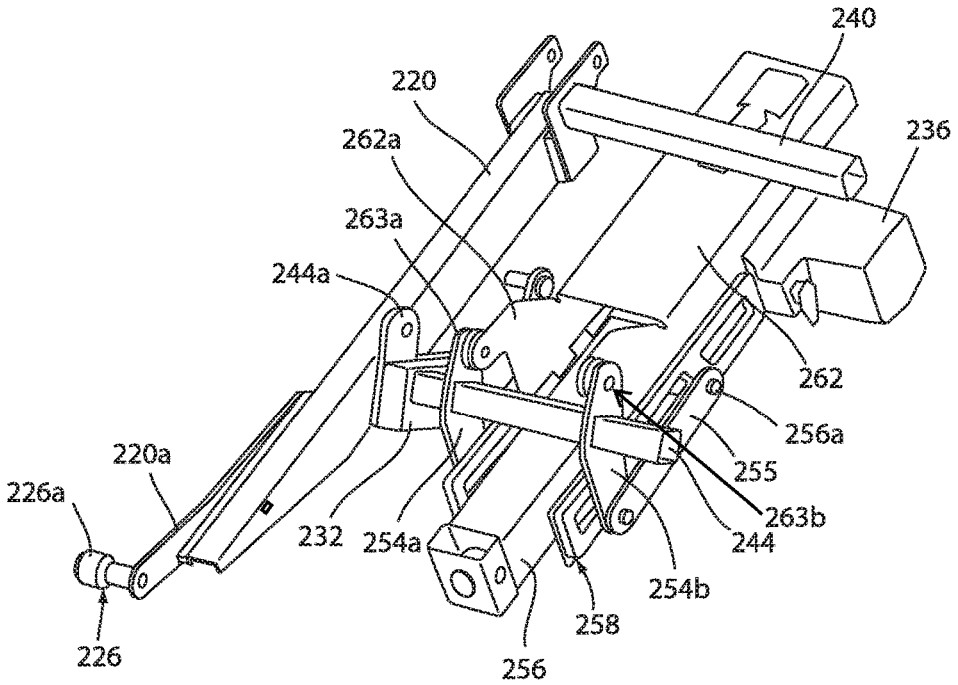
FIG. 33 is a fragmentary view of the lift assembly FIG. 32 showing the actuator mounted to the lifting leg and crank arm.

Referring to FIGS. 32-33, the numeral 218 generally refers to another embodiment of the lift assembly. Similar to the previous embodiments, lift assembly 218 is configured so that when lift assembly 218 is moved to its lowermost configuration, lift assembly 218 may be substantially contained in or fully contained in the base of the patient support. When lift assembly 218 is moved to its lowermost configuration, the deck (not shown) may also be contained within the base. As such, when lowered, the patient support apparatus may be configured so that the distance from the top of deck to the supporting floor is less than 14 inches, less than 13 inches, and optionally less than 12 inches. In this manner, patient support apparatus 10 can provide a very low height patient support apparatus, which can reduce the chance of a patient fall. Furthermore, the space below the base members and between the transverse members of the base is sufficient to allow a base of an overbed table or lift assembly to extend under base. For example, the distance from the underside of the base members to the floor is at least 4", at least 5" or between about 5"-6". As will be more fully described below, the lift assembly includes a pair of lifting legs, which are pivotally and slidably mounted at their lower ends at slidable pivot axes to the base wherein when the frame is raised the lower ends of the lifting legs move outwardly toward the ends of the frame to thereby leave a space sufficient to allow a fluoroscope device to extend between the frame and the base.

For ease of description, reference is made to the head end portion of lifting assembly 218. Further, several of the components are removed for clarity. Referring again to FIG. 32, the head end portion of lifting assembly 218 includes a pair of head end lifting legs 220. Head end lifting legs 220 are pivotally mounted at fixed pivot connections at their upper ends to the deck frame, such as by pivot blocks, by way of brackets 224. The lifting legs 220 are slidably pivotally mounted at sliding pivot connections to the base, which may be formed by bearings 226, such as bushings, rollers, or wheels, mounted at the lower ends of lifting legs, which extend into channels mounted to the inside face of the longitudinal frame members of the base. Furthermore, the lower ends of each lifting leg are connected together by a transverse member 221, such as a tubular member or rod, to thereby form a generally U-shaped leg assembly so that the lifting legs move together in unison.

In this manner, when lifting legs 220 are folded relative to the frame or base, the lower pivot connections (formed by bearings 226) will move inwardly toward the middle of the base. By the same token, when lifting legs 220 are unfolded relative to the frame or base, the lower pivot connections (formed by bearings 226) will move outwardly toward the ends of the base, leaving a space which is sufficient to allow a fluoroscope device to be inserted between the base and the frame of the patient support.

Figure 34:
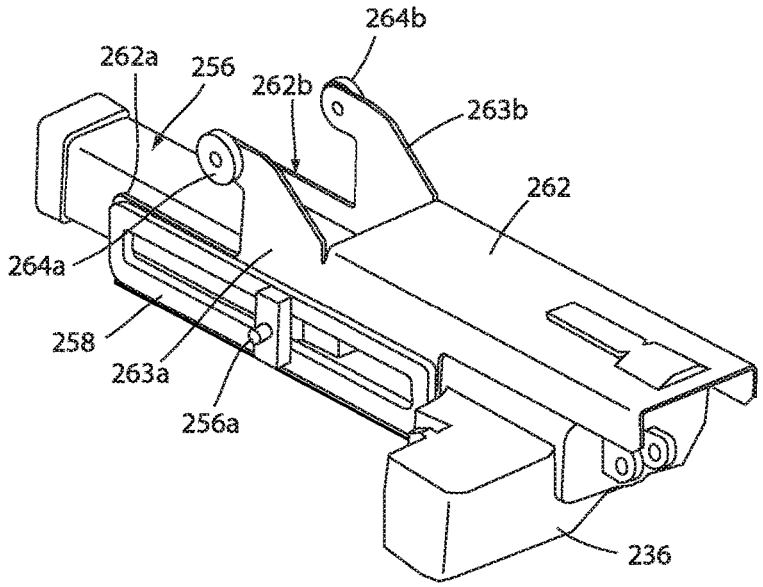
FIG. 34 is an enlarged perspective view of the actuator mounting arrangement.
Figure 35:
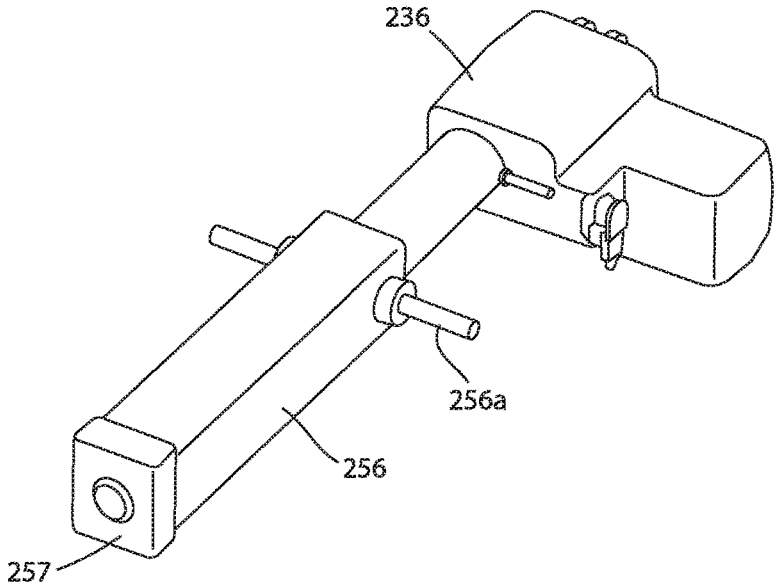
FIG. 35 is another perspective view of the actuator illustrating the offset box.

To move lifting legs 220 between their fully extended configuration, such as shown in FIG. 32, and their lower configurations, such as the configuration shown in FIG. 33, legs 220 include an actuator 236 (FIGS. 33-35). The extendable end or rod of actuator 236 is coupled to legs 220 via levers, such as crank arms 232, which are coupled to actuator 236 (FIGS. 33-35) via an offset mount described below. Each crank arm 232 is pivotally mounted at its upper end to a respective lifting leg, and furthermore optionally pivotally mounted to a medial portion of its respective lifting leg. Upper ends of crank arms 232 support brackets 244*a*, 244*b* for pivotally mounting crank arms 232 to lifting legs 220. The lower ends of crank arms 232 similarly include brackets 245*a*, 245*b* for pivotally mounting lower ends of crank arms 232 to the base. Similar to the first embodiment, crank arms 232 are joined by a transverse member 244 to form a generally inverted U-shaped assembly, which provides a mounting structure for the actuator.

Referring to FIG. 33, actuator 236 is mounted to transverse member 244 by way of an offset mount similar to the first embodiment in order to reduce the installed length of the actuator while still allowing use of the full stroke of the actuator. In the illustrated embodiment, the offset mount includes a box 256 that extends over the extendable rod of the actuator 236, which rod is secured to the distal wall of the box 256. In the illustrated embodiment, the rod of actuator 236 is fixedly mounted to the distal wall of box 256. Alternately, the rod of actuator 236 may be pivotally mounted to the end of box 256, similar to the first embodiment. Box 256 supports a pair of pivot pins 256*a*, which offset the pin connection between the actuator rod and the crank arms 232. In this manner, the actuator 236 will have an installed length that is shorter than its stroke length.

To pivotally mount pins 256*a* to transverse member 244, the offset mount includes a pair of links 255, which couple to the pivot pins 256*a*, and which in turn are pivotally mounted to transverse member 244 by way of brackets 245*a* and 254*b*, which are welded or otherwise secured to transverse member 244. The opposed end of actuator 236 is mounted in a second box 262, which is secured to the upper end of lifting legs 220. Box 262 confines actuator 236 and retains the actuator in a generally parallel relationship to lifting legs 220. Box 262 is secured to transverse member 240 of lifting legs 220, for example, by welding, and also helps support the opposed end of the actuator by way of brackets 258, through which guide pins 256*a* extend and are guided.

Brackets 258 include longitudinal openings 258*a*, which form guide tracks along which guide pins 256*a* are moved when actuator 236 is extended or contracted. In the illustrated embodiment, box 262 includes a pair of extended parallel flanges 262*a*, 262*b* that support brackets 258 and, further, include additional brackets 263*a*, 263*b*, which support bushings 264*a*, 264*b* to pivotally mount box 262 to the upper end of brackets 254*a* and 254*b*, which as noted are mounted to transverse member 244.

Figure 43:
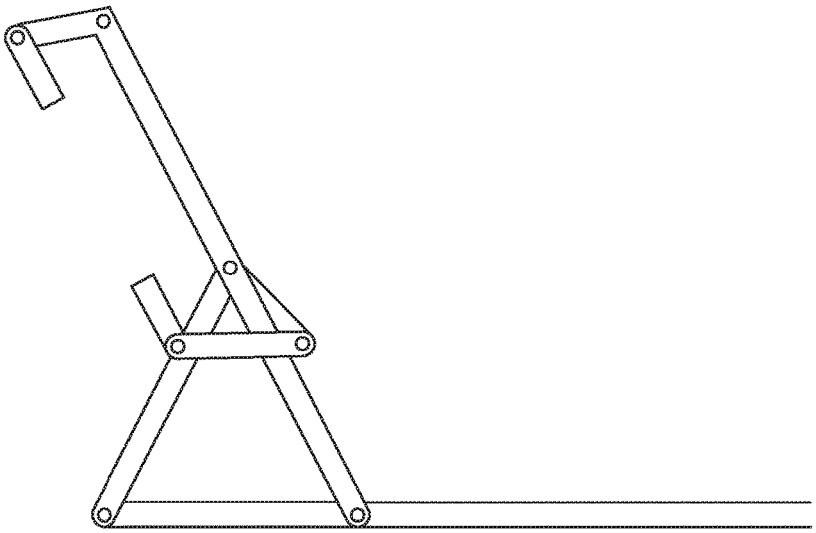
FIG. 43 is a similar view to FIG. 42 with the lift assembly raised to its full height position.

Box 262, therefore, forms a pivotal link of fixed length between the end of actuator (and the upper ends of lifting legs 220) and cranks arms 232, while link 225 forms a pivotal link with varying length between the extendible rod of actuator 236 and crank arms 232. Thus, in contract the first embodiment, where the actuator pushes directly on the crank arm, actuator 236 pushes on the crank arm via a pivotal link. The addition of this additional pivotal link allows the actuation force to be significantly lower when the lift assembly approaches its fully extended position such as shown in FIG. 43.

As noted above, the lower ends of lifting legs 220 are mounted to the base by sliding pivot connections, which can be formed by bushings roller wheels (226). Further, legs 220 and crank arms 232 will fold so that they lie in a plane defined by the base members and, further, so that they lie between an upper plane or boundary and a lower plane or boundary defined by the base members. Similarly, when the frame is in its lowermost position, the frame members of the frame are also aligned in the base between the base members. Further, the frame members are located between the upper and lower boundaries defined by the base members and generally aligned in the same plane as lifting legs 220 and crank arms 32. As a result, the fixed pivot connections and sliding pivot connections will all lie in the same plane.

Figure 36:
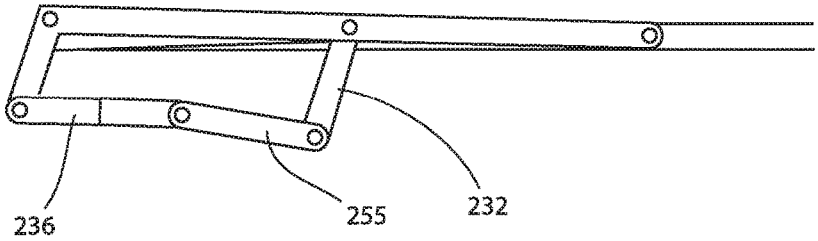
FIG. 36 is a schematic drawing illustrating the lift assembly in its lowermost position.
Figure 37:
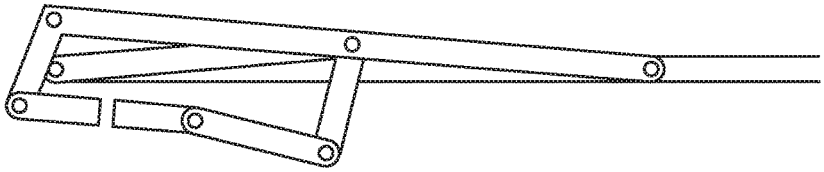
FIG. 37 is a similar view to FIG. 36 with the lift assembly raised about its lowermost position.
Figure 38:
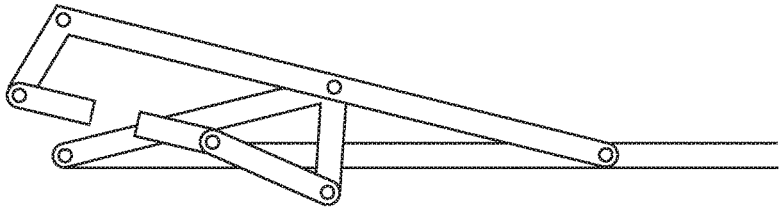
FIG. 38 is a similar view to FIG. 37 with the lift assembly another raised position above the lowermost position.
Figure 39:
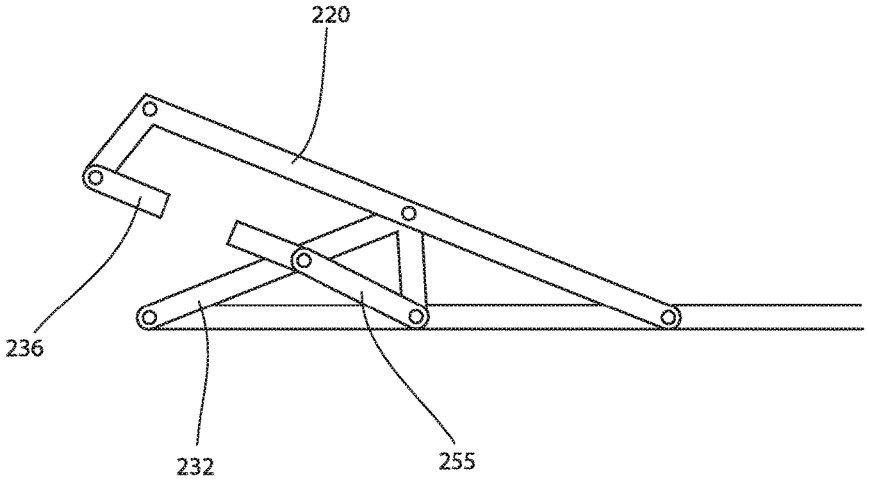
FIG. 39 is a similar view to FIG. 38 with the lift assembly raised to another position above the lowermost position.
Figure 40:
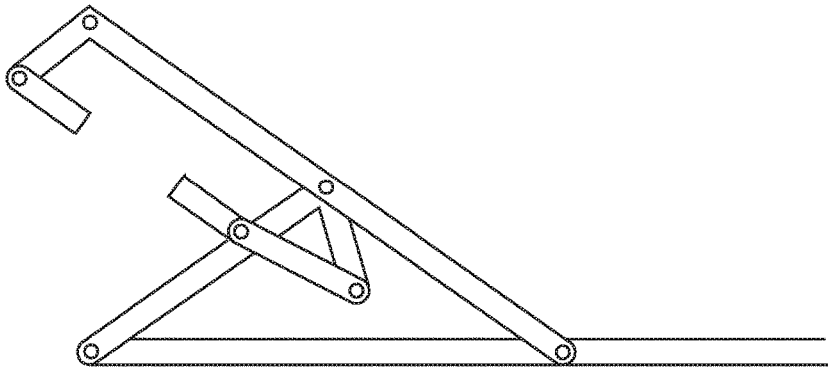
FIG. 40 is a similar view to FIG. 39 with the lift assembly raised to another position above the lowermost position.
Figure 41:
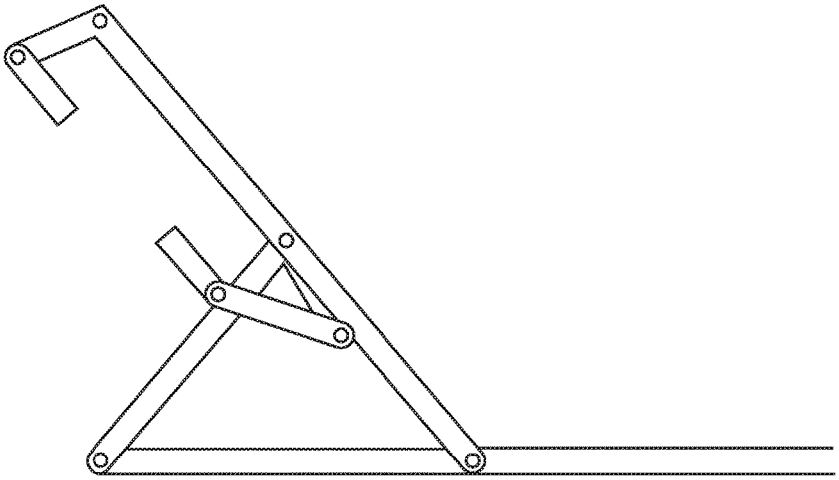
FIG. 41 is a similar view to FIG. 40 with a lift assembly raised to another position above the lowermost position.
Figure 42:
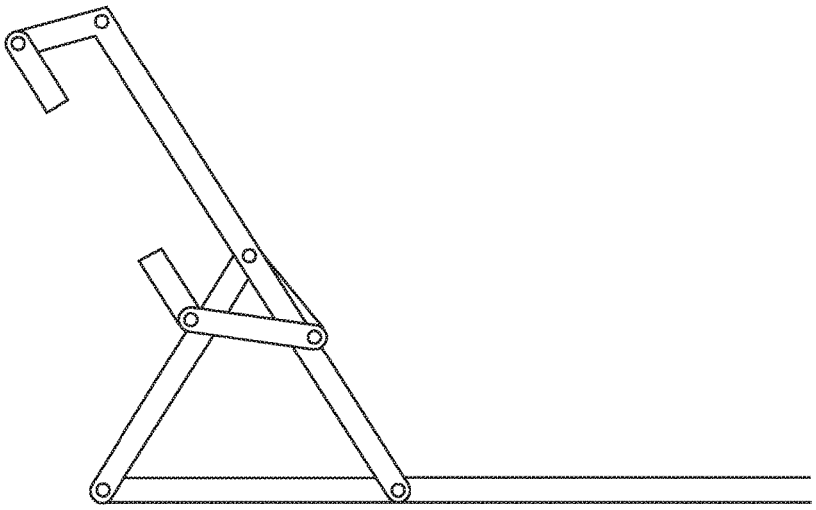
FIG. 42 is a similar view to FIG. 41 the lift assembly further raised above the lowermost position.

Referring to FIGS. 37-43, the motion of lift assembly 218 is shown in reference to one of the lifting leg assemblies, starting from the lowermost position where the actuator is fully retracted. In the lowermost position, legs 220 lie in the same plane as the base, with the actuator and offset mount including link to 55 are extended below the base. As actuator 236 contracts and pulls on transverse member 40 and on cross-member 44, the lower ends of legs 220 move away from the fixed pivot connections of crank arms 232 to the base, and angle A increases until it becomes obtuse, and further about 180 degrees, where legs 220 lie in the same plane as crank arms 232 (see FIG. 36).

FIGS. 37-43 provide simplified, schematic illustrations of the movement and how the forces of actuators 236 are applied to the lifting legs 220. Further, with this configuration, lift assembly 218 can achieve a full range of motion from a very low height to a fully raised position with a fairly low actuator force, for example, less than 7500 N.

As would be understood, because the head end and foot end lifting legs are independent, they can be independently moved to raise or lower the head or foot ends of the frame to move the deck in a Trendelenburg or reverse Trendelenburg position. Additionally, the speeds of each actuator can be independently controlled. For example, suitable actuators include Linak actuators, such as model number LA 40, or Ilcon actuators. For example, the actuators may include sensors or magnets to measure the speed of the actuator so that, as noted, the actuation and speed of each actuator may be independently installed.

Figure 44:
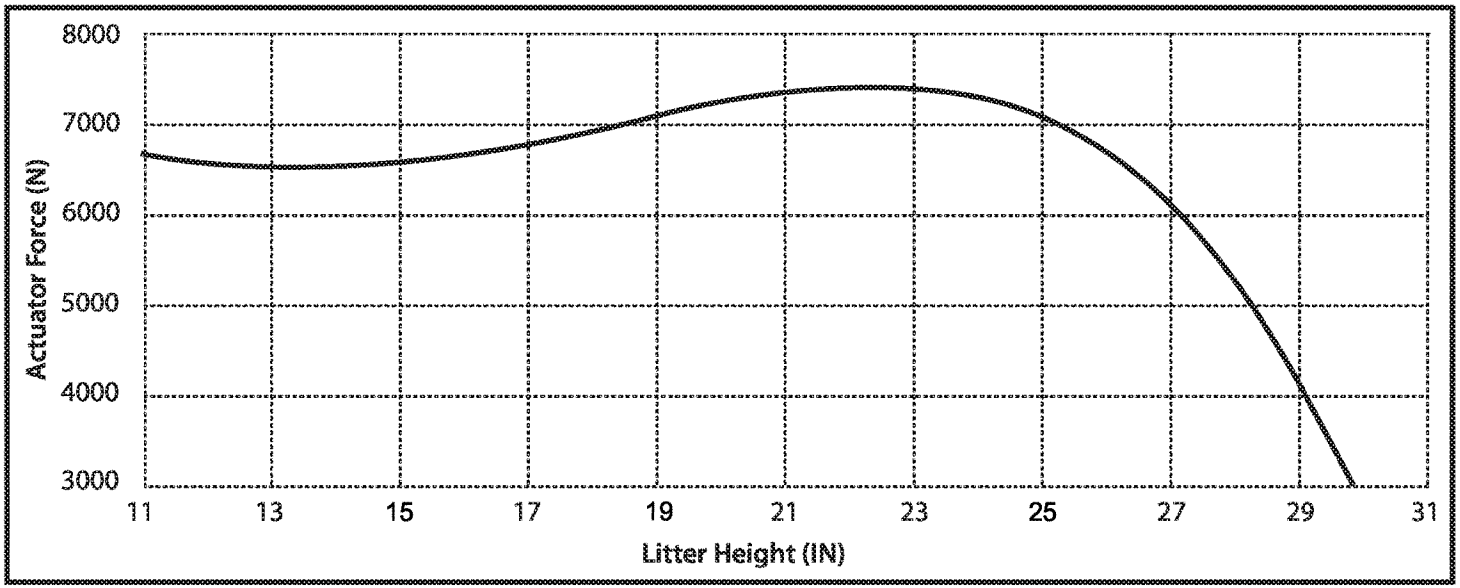
FIG. 44 is a graph illustrating the force versus height over the full range of motion of the lift assembly of FIGS. 32-42.

Referring to FIG. 44, the force of the actuator ranges from about 6800 N when in the lowermost position to about 7400 N when about midway between the lowermost position and then down to about 3000 N when in the uppermost position. As would be understood the greatest force is needed when the lift assembly is in its most compact, lowermost position. As the lifting legs rise up relative to the base, the leverage provided by the crank arms increases. With the addition of the additional link, the force on the actuator reduces significantly as the lift assembly reaches its fully extended position.

Figure 45:
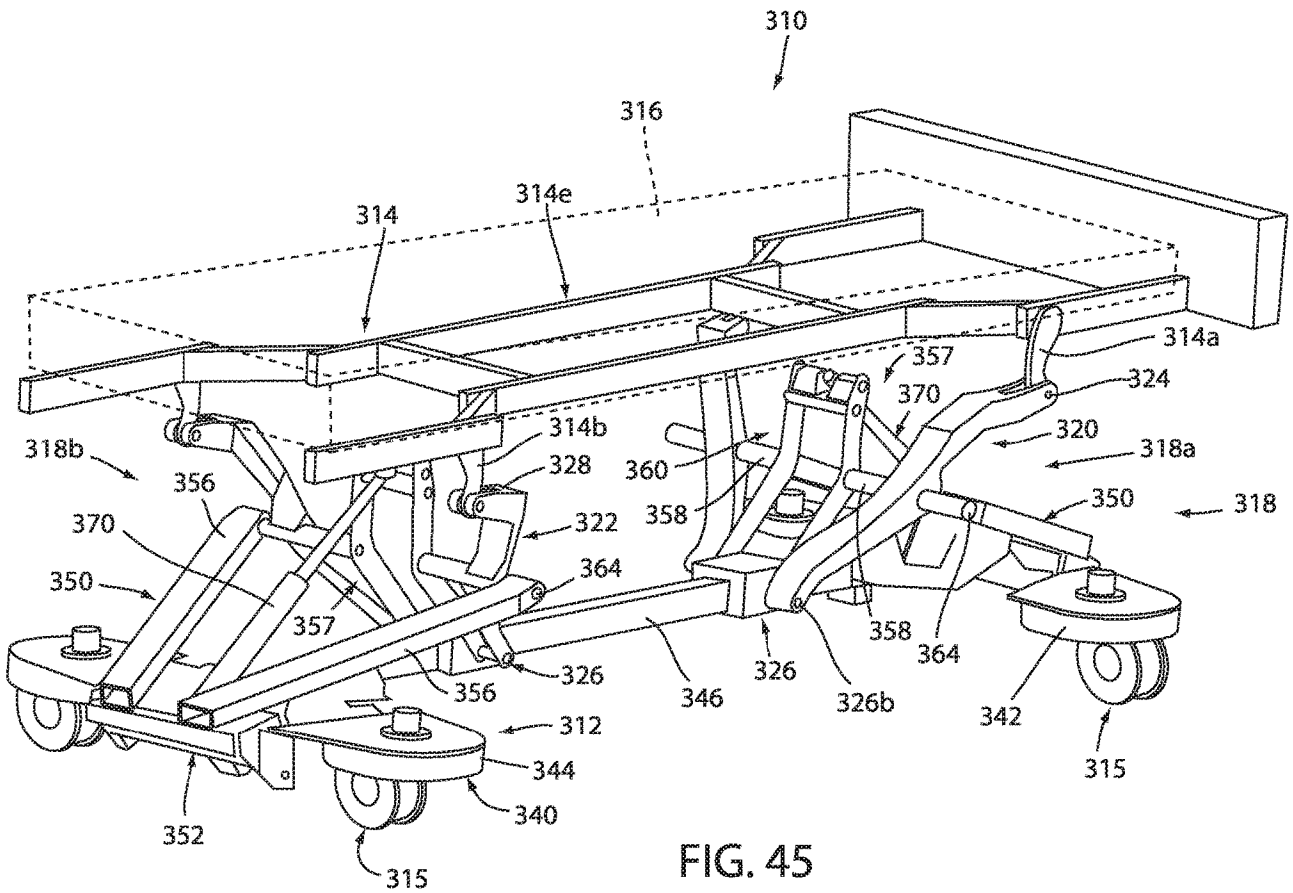
FIG. 45 is a perspective view of another embodiment of a lift assembly with the deck removed to show the lift assembly in a high height configuration.

Referring to FIG. 45, the numeral 310 generally designates another embodiment of a patient support apparatus. In the illustrated embodiment, patient support apparatus 310 is a bed, such as a hospital bed, with the articulating deck 316 shown only in phantom. The construction of the deck, and any headboard, footboard, and/or side rails may take on any known designs, such as, for example, those disclosed in U.S. Pat. No. 7,690,059 issued to Lemire et al., and entitled HOSPITAL BED, commonly assigned to Stryker Corp., the complete disclosure of which is incorporated herein by reference herein in its entirety; or U.S. Pat. No. 8,689,376 entitled PATIENT HANDLING DEVICE INCLUDING LOCAL STATUS INDICATION, ONE-TOUCH FOWLER ANGLE ADJUSTMENT, AND POWER-ON ALARM CONFIGURATION, also commonly assigned to Stryker Corp., the complete disclosure of which is also hereby incorporated by reference herein in its entirety. It should be understood the patient support apparatus 310 may take on other forms, including a stretcher, a cot or the like. In general, patient support apparatus 310 can be used whenever a patient needs to be supported and it is desirable to raise and lower the patient relative to a floor surface or other supporting surface. As will be more fully described below, patient support apparatus 310 includes a lift assembly 318 for raising and lowering the frame and deck (and the patient support apparatus surface, such as a mattress or other cushioning device supported on the deck) between a fully raised (referred also to as the high height position) and a lowermost position, while still leaving clearance sufficient to allow a base of an over bed table or a patient lift or other equipment to be extended under the patient support apparatus. Further, lift assembly 318 is configured to move the deck between a Trendelenburg position and a reverse Trendelenburg position.

As best seen in FIG. 45, patient support apparatus 310 includes a base 312, a support frame 314, such as a deck frame or load frame, for supporting a deck 316 (shown in phantom), and a lift assembly 318 for raising or lowering frame 314 (and deck 316) relative to base 312. Base 312 is a wheeled base with a plurality of caster wheel assemblies 315 to facilitate movement of the bed across a floor surface. Suitable caster wheel assemblies 315 include caster wheels from Tente.

As will be more fully described below, lift assembly 318 is configured to raise or lower frame 314 (and deck 316) from a high height position to a lowermost position while also being able to move the frame between Trendelenburg position and a reverse Trendelenburg position all while providing a clearance under the frame 314. Further, lift assembly 318 is configured so that when lift assembly 318 is moved to its lowermost configuration, lift assembly 318 may be substantially contained between the upper and lower planes of the base frame (described more fully below) of base 312. For example, the lowermost portion of lift assembly 318 extends no more than 2 to 3 inches, optionally no more than about 2 inches below the lower plane of the frame 340 of base 312, which facilitates patient support apparatus 310 achieving a low height, while still providing sufficient clearance or space to allow an overbed table or patient lift to move under base 312 even when the frame is in its lowermost position, as more full described below in reference to FIGS. 51A and 51B.

Figure 49:
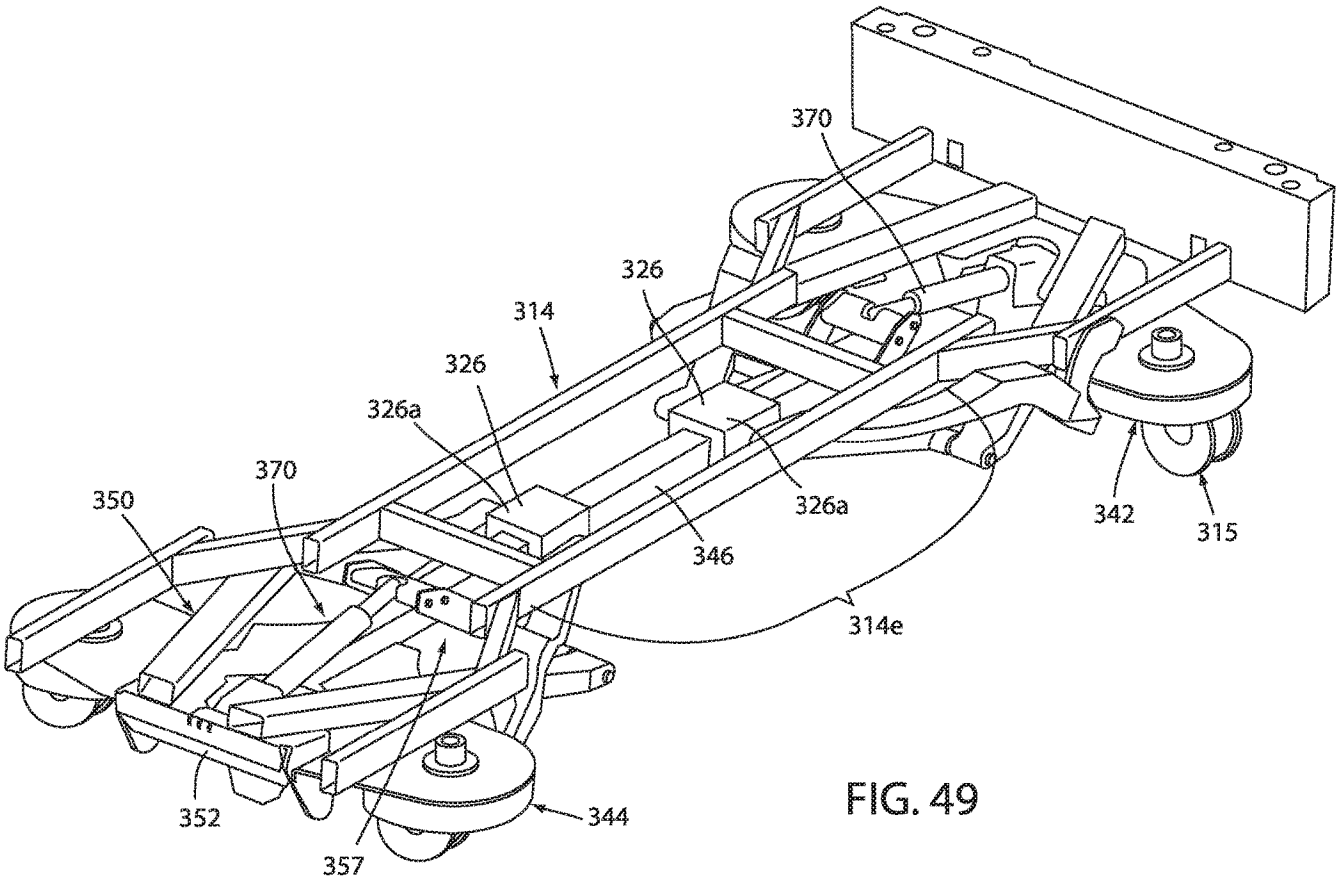
FIG. 49 is a perspective view of the lift assembly of FIG. 45 in its lowermost position.
Figure 50:
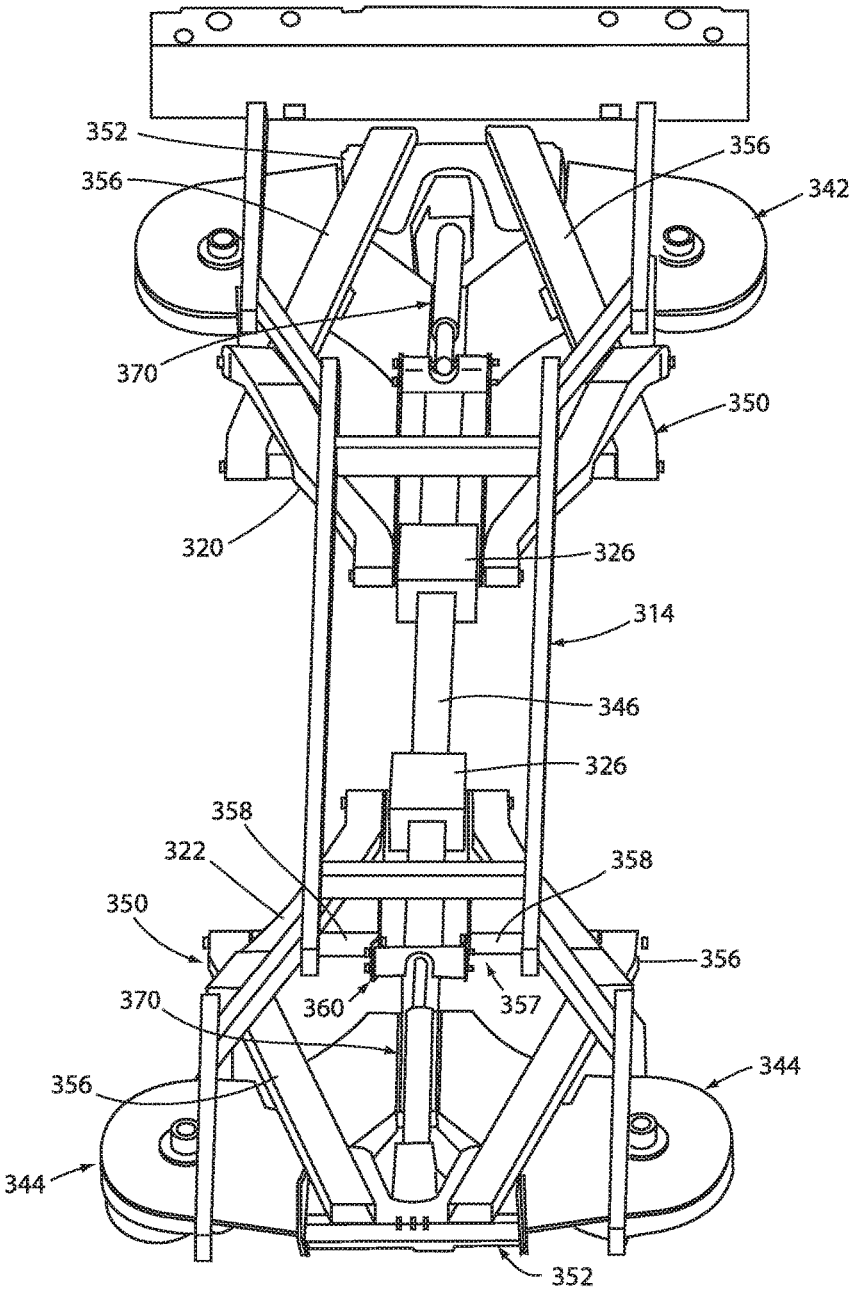
FIG. 50 is another perspective view of the lift assembly of FIG. 49.

For example, in the illustrated embodiment, patient support apparatus 310 may be configured so that the distance from the top of deck 316 to the supporting floor is less than 14 inches, less than 13 inches, less than 12 inches, and optionally about 10 inches. Further, when the Fowler (head end section of the deck) is raised, the seat section of the deck can be lowered to about 8 inches off the floor. Additionally, when lift assembly 318 is moved to its lowermost configuration, such as shown in FIG. 49, the lift actuators remain at an angle relative to the frame 340 of base 12, as will be more fully described below, to allow the actuators to still generate sufficient force to the lift assembly even when the frame 314 (and deck) is in its lowermost position. In this manner, patient support apparatus 310 can also provide a very low height patient support apparatus, which can reduce the chance of a patient fall.

Referring again to FIG. 45, lift assembly 318 includes a head end leg assembly 318*a* and a foot end leg assembly 318*b*. Head end leg assembly 318*a* includes a pair of head end lifting legs 320 and an actuator frame 350, more fully described below. Similarly, foot end leg assembly 318*b* includes a pair of foot end lifting legs 322 and actuator frame 350. Head end lifting legs 320 are pivotally mounted at their upper ends to support frame 314 at fixed pivot connections 324, such as formed pivot shafts journaled in bushings mounted to frame 314. In the illustrated embodiment, deck 314 includes downwardly depending arms 314*a*, which support the bushings to form pivot connections 324. At their lower ends, legs 320 are slidably pivotally mounted at sliding pivot connections 326 to base 312.

Similarly, legs 322 are pivotally mounted at their upper ends to frame 314 by pivot connections 328, which also may be formed by pivot shafts journaled in bushings supported by deck 314. Further, similar to the head end legs 320, pivot connections 328 of foot end legs 322 are located in downwardly depending arms 314*b*, which extend outwardly from frame 314. However, pivot connections 324 are moving pivot connections to accommodate the differential movement of the two leg assemblies. The moving pivot connections may be provided by a slotted opening in each arm 314*b* or by links (not shown), with each link pivotally coupled on one end to an upper end upper of respective leg 322 and pivotally coupled at an opposed end to a respective downwardly depending arm 314*b*.

Figure 45A:
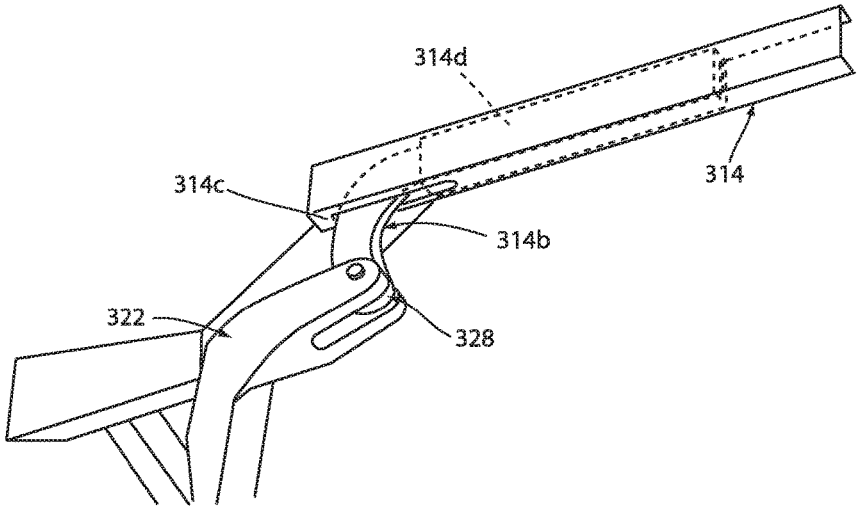
FIG. 45A is an enlarged perspective view of the foot end of the lift assembly of FIG. 45.

Alternately shown in FIG. 45A, the movement at pivot connection 328 may be accommodated by a sliding connection 328*a*. As best seen in FIG. 45A, sliding pivot connection 328*a* is formed between downwardly depending arm 314*b* and frame 314. For example, arm 314*b* may be mounted to frame 314 and extended through a slotted opening 314*c* provided in frame 314. For example, frame 314 may be formed from tubular members with slotted opening 314 C provided at the lower die of the frame's tubular member. In addition, arm 314*b* may be mounted to a tubular member 314*d*, which is nested in frame 314. Optionally, arm 314*b* is pivotally mounted to tubular member 314*d*. Further, tubular member 314*d* may include one or more low friction surfaces, for example, at its upper and lower side to reduce the friction between tubular member 314*d* and the tubular member of frame 314. In addition, tubular member 314*d* may include a stop to limit extension of arm 314*b* along slot 314*c*. It should be understood that the movement of tubular member 314*b* will limited by differential movement between the two leg assemblies 318*a*, 318*b*. As such, no stop may be needed.

Lower ends of legs 322 are similarly coupled to base 312 by sliding pivot connections 326. Each sliding pivot connection 326 includes a sliding block 326*a*, which is slidably mounted on a longitudinal frame member 346 of base 312 and which supports a pair of outwardly depending pivot shafts or pins 326*b*, to which each respective leg 320, 322 is rotatably mounted to thereby form the sliding pivot connections 326. Further, as will be more fully described, sliding pivots connections 326 couple to actuator frames 350, which transmit the forces from the actuators to the respective lifting legs of the lift assembly 318.

In the illustrated embodiment, base 312 includes a base frame 340, which is formed by head end and foot end frame members 342 and 344, which are interconnected by longitudinal frame member 346. Longitudinal frame member 346 forms a beam, as noted, along which sliding pivot connections 326 move or translate when legs 320, 322 pivot about their respective pivot axes, as described more fully below. Frame members 342 and 344 provide mounts for caster wheel assembly 315 and the actuator frames 350 described below. The upper plane of base frame 340 is defined by the upper surfaces of frame members 342, 344 and of longitudinal frame member 346, which lie in a common plane. And the lower plane of base frame 340 is defined by the lower surface of longitudinal frame member 346. As noted above, when lift assembly 318 is in its fully folded configuration and frame 314 is in its lowermost position, lift assembly 318 is substantially contained between the upper and lower planes of base frame 340 to form a compact lift assembly, which allows the deck and frame 314 to move to a low height, as described above.

For ease of description, reference will be made to the head end frame 342, head end actuator frame 350, and head end actuator 370, but it should be understood that the foot end frame 344, foot end actuator frame 350, and foot end actuator 370 have the same arrangement, but in the illustrated embodiment are a mirror image of the head end arrangement. Therefore, when not specifically mentioned, like parts at the foot end are numbered in the drawings with the same numerals as the head end.

Figure 46:
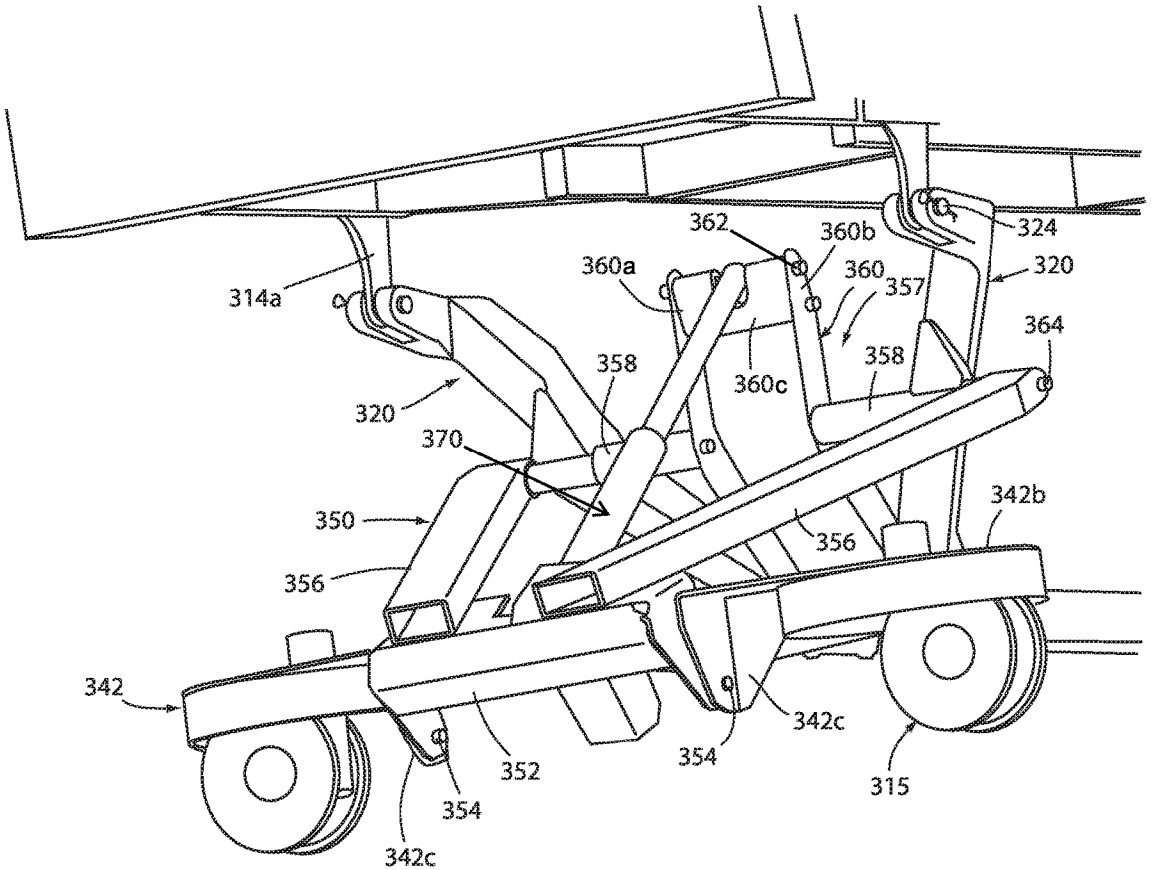
FIG. 46 is an enlarged perspective view of the head end of the lift assembly of FIG. 45.
Figure 46A:
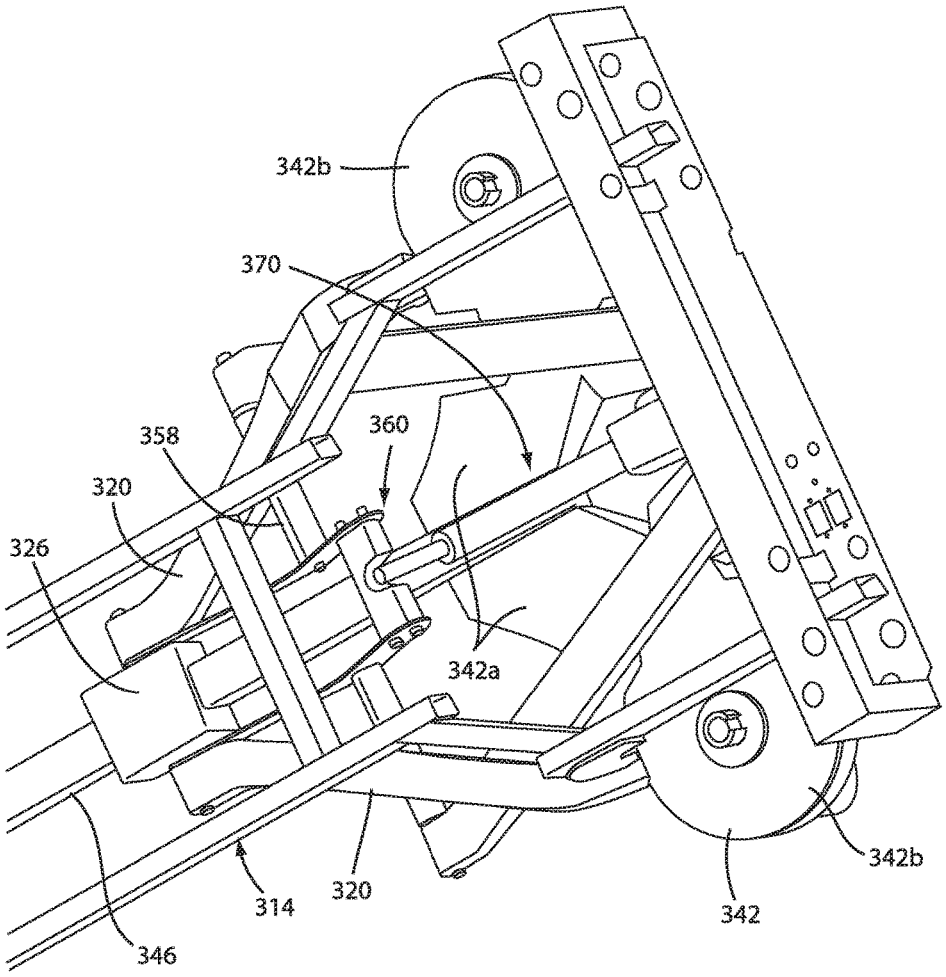
FIG. 46A is an enlarged plan view of the head end of the lift assembly of FIG. 45.

Referring to FIG. 46A, head end frame member 342 is formed by two plates 342*a* that mount to either side of longitudinal frame member 346. Plates 342*a* have downwardly depending flanges along their sides that reinforce and stiffen the plates, and further provide mounting surfaces for the respective plates. Plates 342*a* mount to longitudinal frame member 346 by fasteners that extend through the downwardly depending flanges and into longitudinal frame member 346 that is positioned between the downwardly depending flanges. Plates 342*a* are angled forwardly toward the head end from their point of connection to longitudinal frame member 346 and terminate at enlarged ends 342*b*, which form the mounting surfaces for caster wheel assemblies 315. Optionally, each end 342*b* is circular with a downwardly depending flange, which encircles the outer path of the respective caster wheel assembly. Additional stiffening flanges may be provided on the underside of plates 342*a*.

Actuator 370 is coupled between base 312 and lifting leg 320 by two levers, with one lever eccentrically coupled to the lifting leg 320 about its folding pivot axis 320*a* to apply forces to the lifting leg 320 above its folding pivot axis 320*a* and the other lever coupled to base 312. The second lever extends beneath the lower plane of base frame 340, and further mounts the end of the respective actuator 370 about pivot axis 354*a*, which is outside the footprint of caster wheel assemblies 315. The levers thus allow a longer actuator to be used, and therefore provide a greater stroke. Further, they remove the torque from the frame 314 and base 312, and instead apply the torque to leg assembly 318*a*, 318 *b*.

Both levers are formed by an actuator frame 350. Actuator frame 350 is pivotally mounted between enlarged ends 342*b* of base frame 340. Actuator frame 350 is also pivotally coupled to both legs 320 via pivotal frame 357 (described below) and, as noted, provides a mount for the actuator 370. As best seen in FIG. 46, actuator frame 350 is generally a V-shaped frame with a base member 352 and a pair of diverging frame members 356 that are rigidly coupled to base number 352 and extend from base member 352 to support pivotal frame 357 for transmitting the forces from the actuator 370 to the legs 320. Frame members 356 may be formed from tubular members, which are welded or fastened or otherwise mounted to or formed with base member 352 to thereby form a rigid frame.

Base member 352 extends between enlarged ends 342*b* of head end frame member 342 and is pivotally mounted between enlarged ends 342*b* by pivot connections 354, which are formed by bolts or pins that extend through downwardly depending flanges 342*c* of enlarged ends 342*b*. As will be more fully described below, each base member 352 forms the lever between the actuators 370 and the base 312.

Pivotal frame 357 includes an offset frame 360, which is rotatably mounted between frame members 356 by pair of transverse cylindrical members 358. Cylindrical members 358 are journaled or otherwise rotatably mounted to the respective ends of frame members 356, for example, by shaft and bushing mounts 364 and, further, are fixedly coupled to legs 320 about the legs central or medial folding pivot axis 320*a*.

Offset frame 360 is formed by a pair of spaced apart plates 360*a* and 360*b*, which are rigidly coupled to the distal ends of cylindrical members 358, such as by welds or fasteners (or formed therewith), to form a rigid rotating frame. Plates 360*a* and 360*b* are joined together at their upper ends by a transverse member 360*c* and pivotally mounted at their lower ends to sliding pivot connection 326 (FIG. 45). Transverse member 360*c* extends between the respective plates 360*a*, 360*b* and is fixedly mounted between the respective plates 360*a*, 360*b* by a pair of transverse pins or bolts 362. The upper transverse pin 362 forms an actuator pin for actuator 370 to pivotally mount actuator 370 to offset frame 360. In this manner, pivotal frame 357 forms the second lever.

Figure 46B:
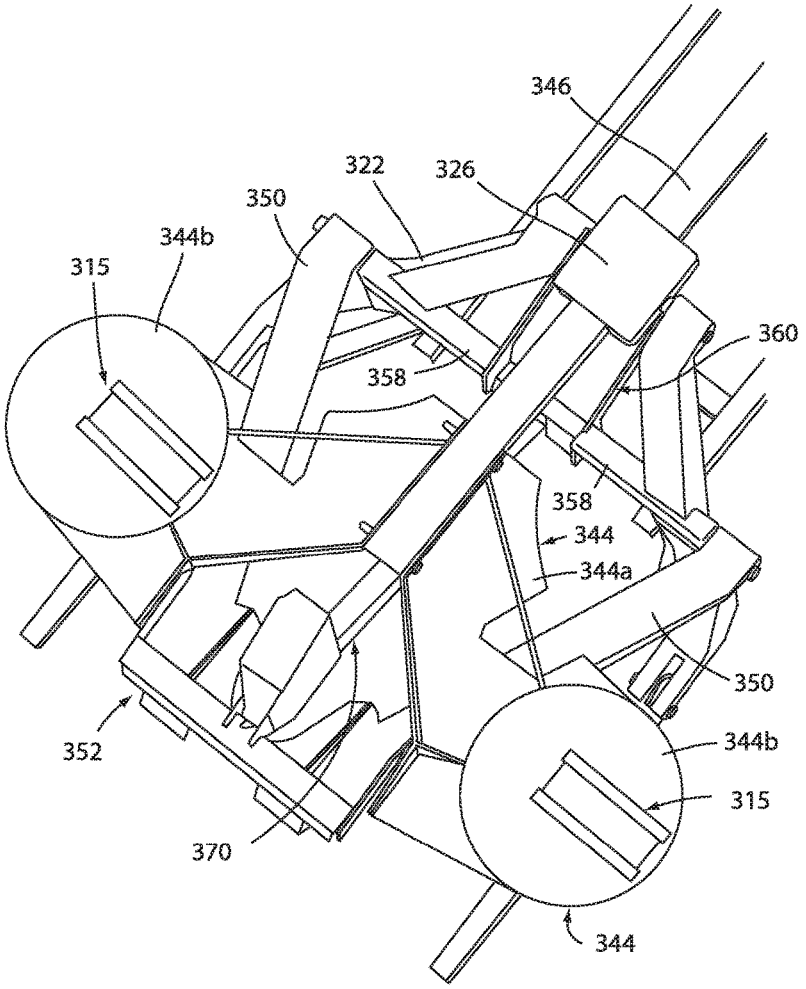
FIG. 46B is an enlarged bottom plan view of the foot end of the lift assembly of FIG. 45.

Referring to FIGS. 46 and 46B, as noted above, cylindrical members 358 are fixedly mounted to legs 320, such as by welds or fasteners (or formed therewith), to form the pivot connection for the pivot axis 320*a* for legs 320 so that as pivotal frame 357 pivots about the ends of frame members 356 and about sliding pivot connections 326 (in response to the extension or contraction of actuator 370), legs 320 will pivot with cylindrical members 358 about actuator frame 350 and pivot and translate along base about sliding pivot connections 326 to thereby raise or lower frame 314 (and hence deck 316).

Figure 46C:
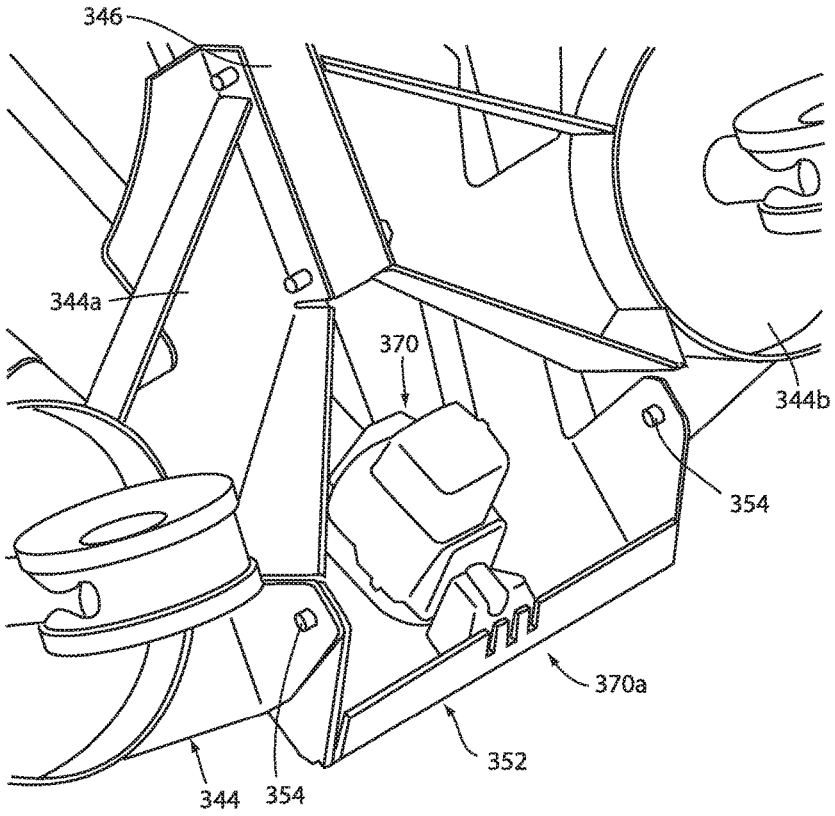
FIG. 46C is an enlarged bottom plan view of the foot end of the lift assembly of FIG. 45.

Referring again to FIG. 46, each actuator 370 comprises an extendable linear actuator, such as a Linak actuator, such as model number LA 40, or an Ilcon actuator. For example, the actuators may include sensors or magnets to measure the speed of the actuator so that the actuation and speed of each actuator may be independently controlled. Further, the motor housing may be pivotally mounted to base member 352 by a bracket 370*a* (FIG. 46C) and its extendible driver or rod pivotally mounted to upper transverse member 360*c* by actuator pin 362. In this manner, the pivot axis and pivot connection of the lower end of actuator 370 to base 312 is below base frame 340, and the upper pivot axis or connection of the actuator 370 is above the folding pivot axis of the respective legs 320, 322. Further, when patient support apparatus 310 is in a lowermost position, and actuators 370 extend, pivotal frames 357 will pivot toward the center of the patient support apparatus 310 (the foot end pivotal frame 357 will pivot toward the head end of the patient support apparatus 310, and the head end pivotal frame 357 will pivot toward the foot end of the patient support apparatus 310). The pivoting of each of the pivotal frames 357 toward the center of the patient support apparatus 310 will cause legs 320 and 322 to pivot about their respective folding pivot axes and about sliding pivot connections 326 and pivot connections 324 and 328, with sliding pivots 326 sliding away from the center of the patient support apparatus 310 toward the respective foot end and head end of base 312, to thereby raise frame 314.

In the reverse, when patient support apparatus 310 is in its high height position, and actuators 370 are retracted, pivotal frames 357 will pivot away from the center of the patient support apparatus 310 (the head end pivotal frame 357 will pivot toward the head end of the patient support apparatus 310, and the foot end pivotal frame 357 will pivot toward the foot end of the patient support apparatus 310). The pivoting of the pivotal frames 357 away from the center of the patient support apparatus 310 will cause legs 320 and 322 to pivot about sliding pivot connections 326 and about pivot connections 324 and 328, with sliding pivots 326 sliding toward the center of the patient support apparatus 310, to thereby lower frame 314. If the actuators at both the head end and foot end are actuated to extend or retract at the same speed, frame 314 will raise or lower parallel to the floor surface.

Should actuators 370 be driven at different speeds or one is driven to extend while the other actuator is contracted, frame 314 may be tilted, for example, into Trendelenburg or reverse Trendelenburg position. For example, when frame 314 is raised to its high height as shown in FIG. 45, actuator 370 at the foot end of frame 314 may be contracted to push the sliding pivot connection 326 of legs 322 toward the head end of frame 314 to cause legs 322 to pivot about their pivot axes and lower the foot end of frame 314 until legs 322 are fully folded at which point frame 314 is in a Trendelenburg position. On the other hand, when frame 314 is in its high height position and actuator 370 at the head end of the frame 314 is contracted instead, the head end of frame 314 will be lowered until legs 320 are fully folded at which point frame 314 would be in a reverse Trendelenburg position. The motion of frame 314 and of lift assembly 318 is best understood from FIG. 53A-53S.

As best seen in FIG. 49, when frame 314 is in its lowermost position, actuator 370 remains angled with respect to the floor surface so that actuators 370 have sufficient power to raise frame 314 even when frame 314 is in its lowermost position. In the illustrated embodiment, as noted, each actuator 370 comprises a linear actuator. Further, because each actuator 370 drives lift assembly 318 via two levers—one lever being formed by base member 352 of actuator frame 350 (FIG. 46C), and the other being formed by pivotal frame 357—the length of the actuators can be increased without interfering with the low height configuration of the patient support apparatus. Further, as noted the use of the two levers allows the torque to be taken out of the litter and the base, and instead allows it to be transferred to the leg assemblies.

Figure 52:
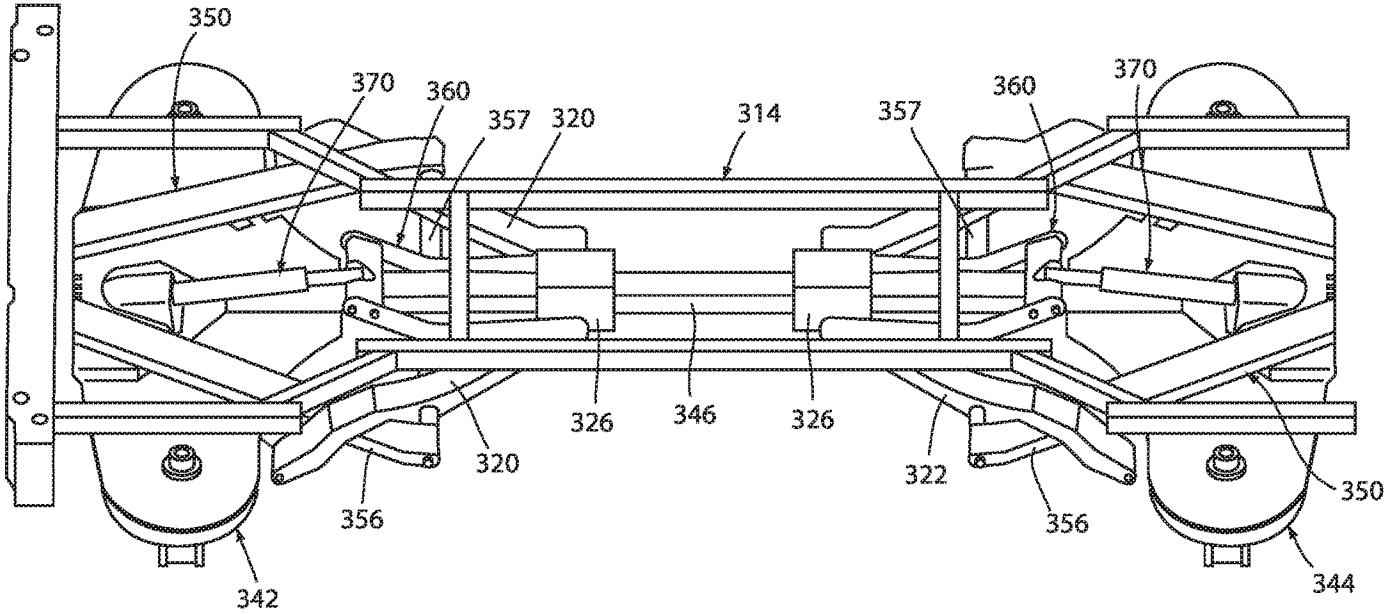
FIG. 52 is a bottom perspective view of the lift assembly of FIG. 49.
Figure 52A:
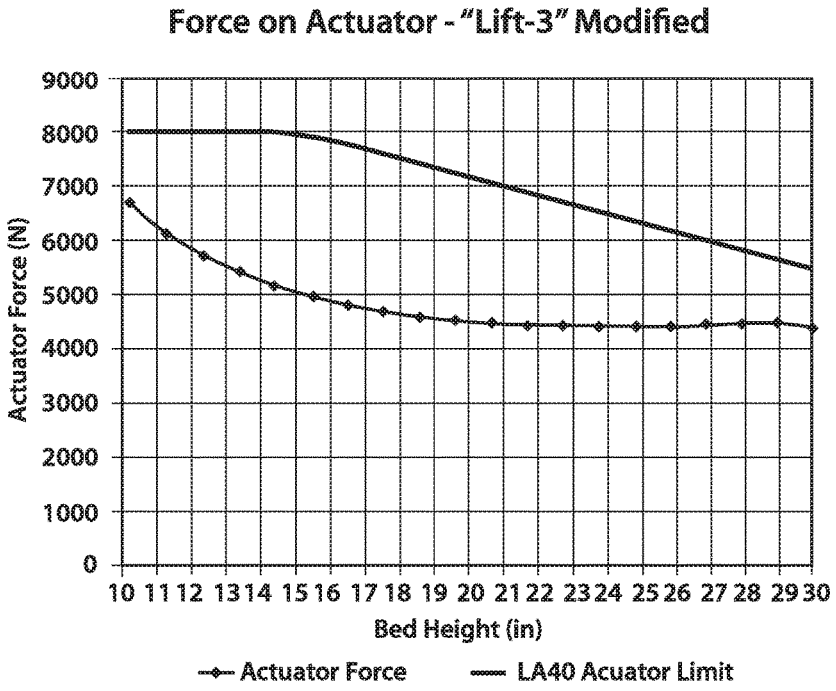
FIG. 52A is a graph of the force versus height of the actuators of the lift assembly of FIG. 45.

Referring to FIG. 52A, the force of each actuator ranges from about 6800 N when in the lowermost position to about 4500 N when about midway between the lowermost position and the high height position, and then remains at about 4500 N even when in the high height position. As would be understood the greatest force is needed when the lift assembly is in its most compact, lowermost position. As the lifting legs rise up relative to the base, the leverage provided by the two levers increases to thereby reduce the forces needed by the actuators.

Figure 51:
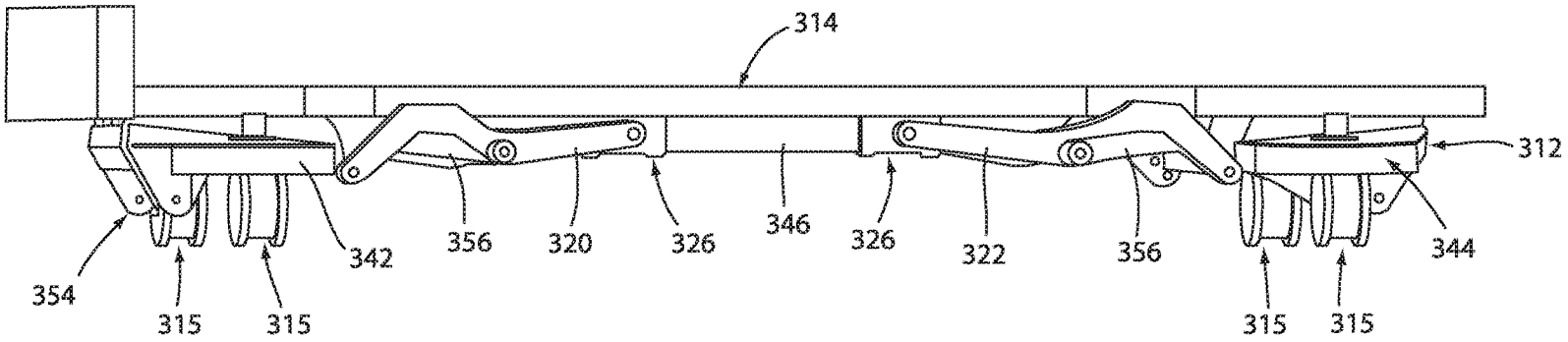
FIG. 51 is a side elevation view of the lift assembly of FIG. 49.

Further, as best seen in FIG. 51, when frame 314 is lowered to its lowermost position, lift assembly 318 and transverse member 346 are arranged to provide a space below base 312 that is sufficient to allow a base of an overbed table or patient lift assembly to extend under base 312. For example, the distance from the underside of the lowest point or base 312 or the component of lift assembly 318 to the floor is at least 4", at least 5" or between about 5"-6".

Figure 51A:
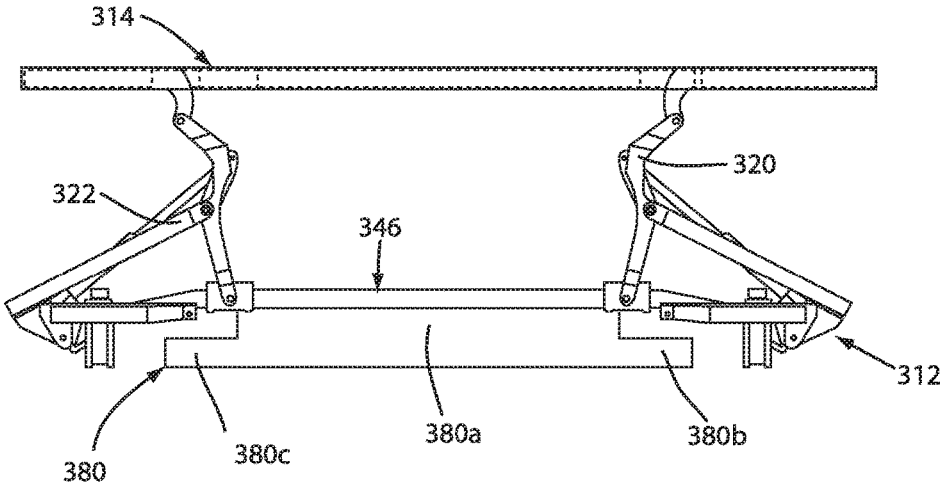
FIG. 51A is a side elevation view of the lift assembly of FIG. 45 illustrating the space beneath the base when in the high height position.
Figure 51B:
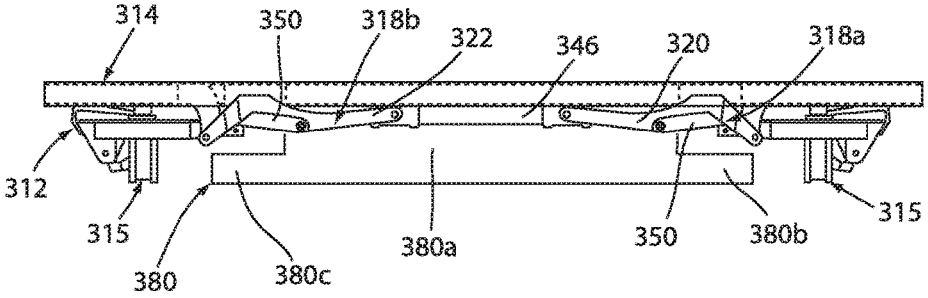
FIG. 51B is a side elevation view of the lift assembly of FIG. 45 illustrating the space beneath the base when in the high height position.

As best seen in FIGS. 51A and 51B, a space 380 is provided below base 312. As noted above, space 380 is configured to provide sufficient room under base 312 to allow an overbed table or patient lift assembly, or other equipment, to extend under base 312. Space 380 is configured with a central region 380*a*, which extends under longitudinal member 346 over a distance which corresponds to the length of the central narrower section 314*e* (FIG. 45) of frame 314, for example, a distance of about 38-40 inches. Central region 380*a* has a height of about 5-7 inches, and optionally a height of about 6 inches. When frame 314 is in its high height position, central region 380*a* is free of any encroachment by the lift assembly 318. Further, space 380 includes an extended head end region 380*b* and an extended foot end region 380*c*, which extend longitudinally from the respective ends of central region 380*a* toward the head end and foot end of base 312, respectively. Regions 380*b* and 380*c* longitudinally extend to align with the upper pivot connections 324, 328, respectively, and extend, for example, over a distance in a range of 53-55 inches and have a height lower than 6 inches, for example the range of 2 to 4 inches, and optionally about 3 inches. Regions 380*b* and 380*c* are also free of any encroachment by lift assembly 318 when frame 314 is in its high height position.

Referring to FIG. 51B, when frame 314 is in its lowermost position, regions 380*b* and 380*c* remain free of any encroachment by lift assembly 318. Region 380*a* is also generally free of encroachment by lift assembly 318, but is encroached it at its outer ends by the pivotal connections between the actuator frames 350 and legs 320, 322. The encroachment is only over a limited longitudinal distance inward from each opposed end of central space 380*a*, for example, in a range of 5-7 inches, with the encroachment vertically downwardly extending into the space 380 in a range of 1-2 inches, and optionally about 1 inch.

Figure 47:
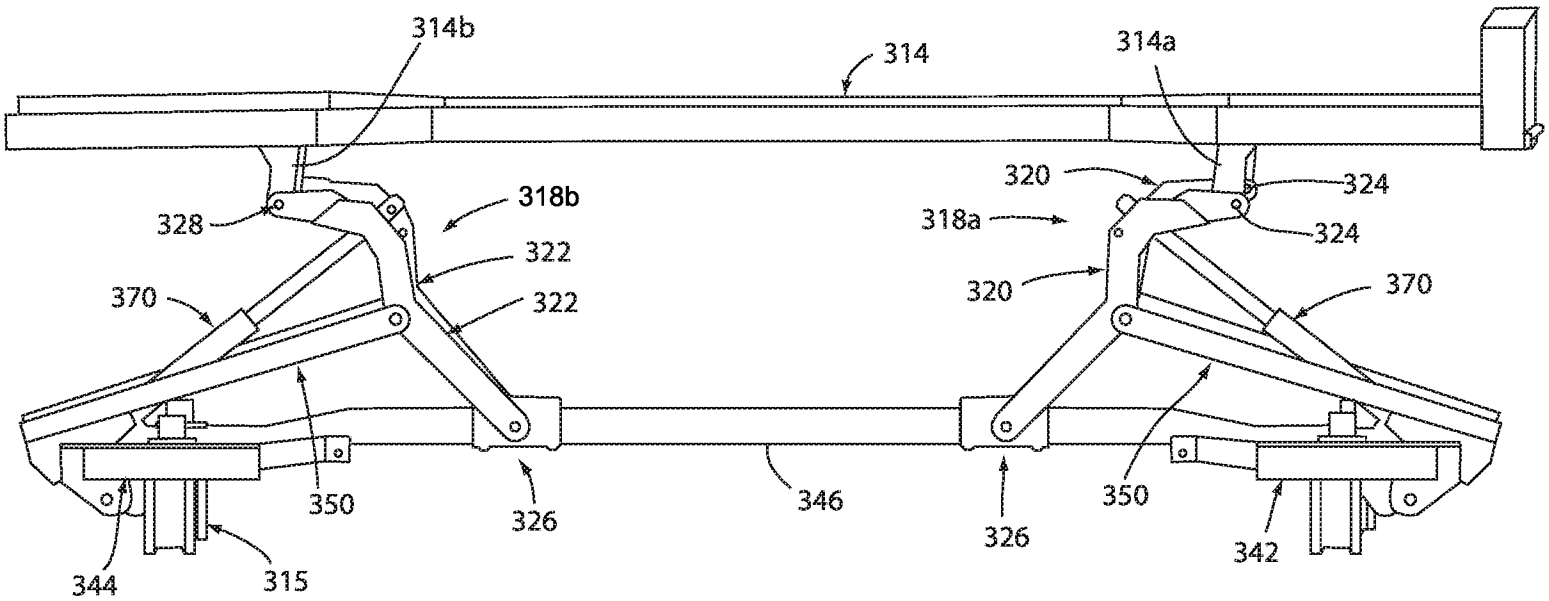
FIG. 47 is a side elevation view of the lift assembly of FIG. 45.
Figure 48:
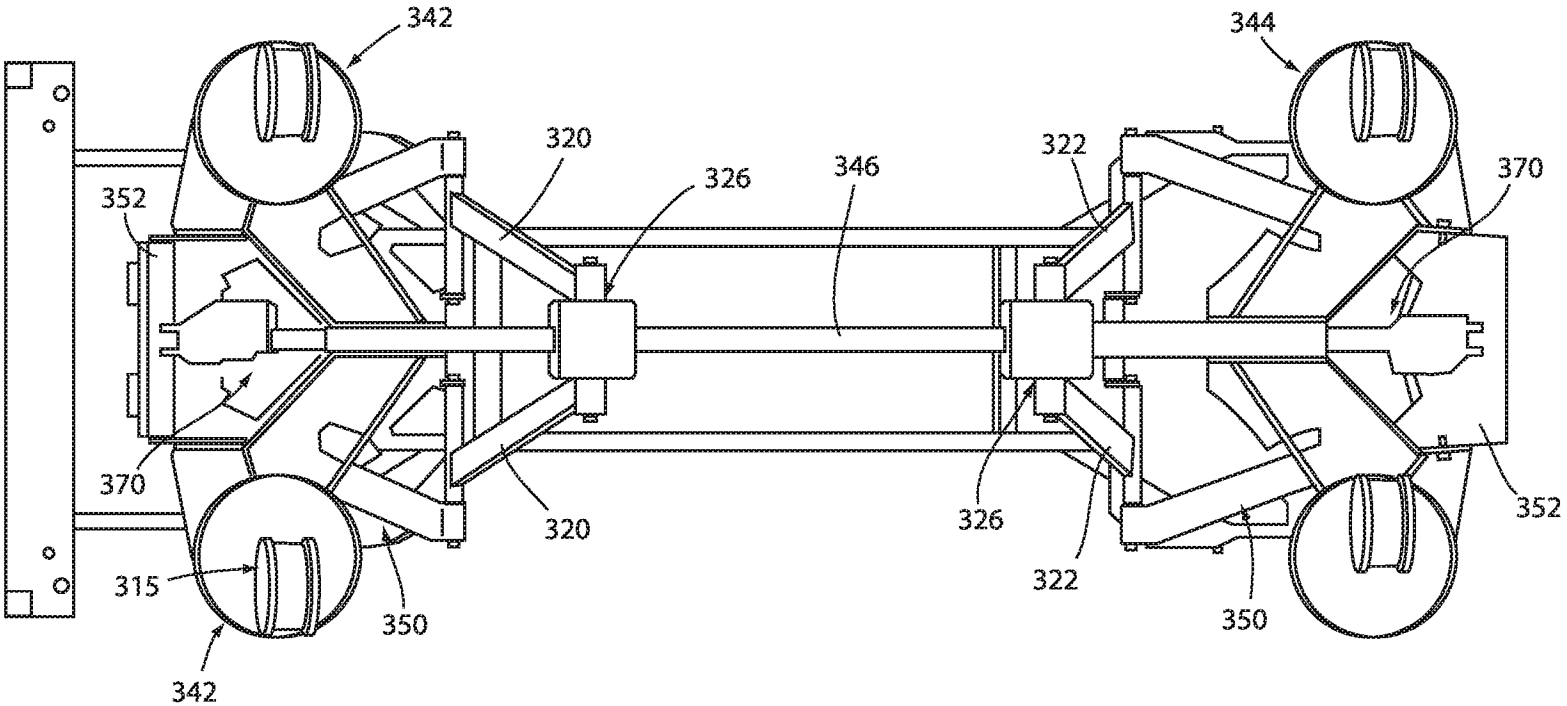
FIG. 48 is a bottom plan view of the lift assembly of FIG. 45.

Referring to FIG. 47, when raised, legs 320, 322 have a Y-shaped configuration with their respective actuator frames 350. In the illustrated embodiment, the Y-shaped configurations are inverted Y-shaped configurations. Further, the upper portion of each leg 320, 322 has a generally arcuate or C shape. In the illustrated embodiment, legs 320, 322 have mirror images, with their C shape upper portions facing in opposed directions. As noted above, the pivot connections 324 for legs 320 may be longitudinally fixed relative to the long axis of the frame 314, while the pivot connections 328 for legs 322 are movable to accommodate a full range of motion for frame 314 between its lowermost position, its high height position, a Trendelenburg position, and a reverse Trendelenburg position. However it should be understood that pivot connections 324 may be configured as movable pivot connections, while pivot connections 328 may be longitudinally fixed along the long axis of frame 314.

Figure 54:
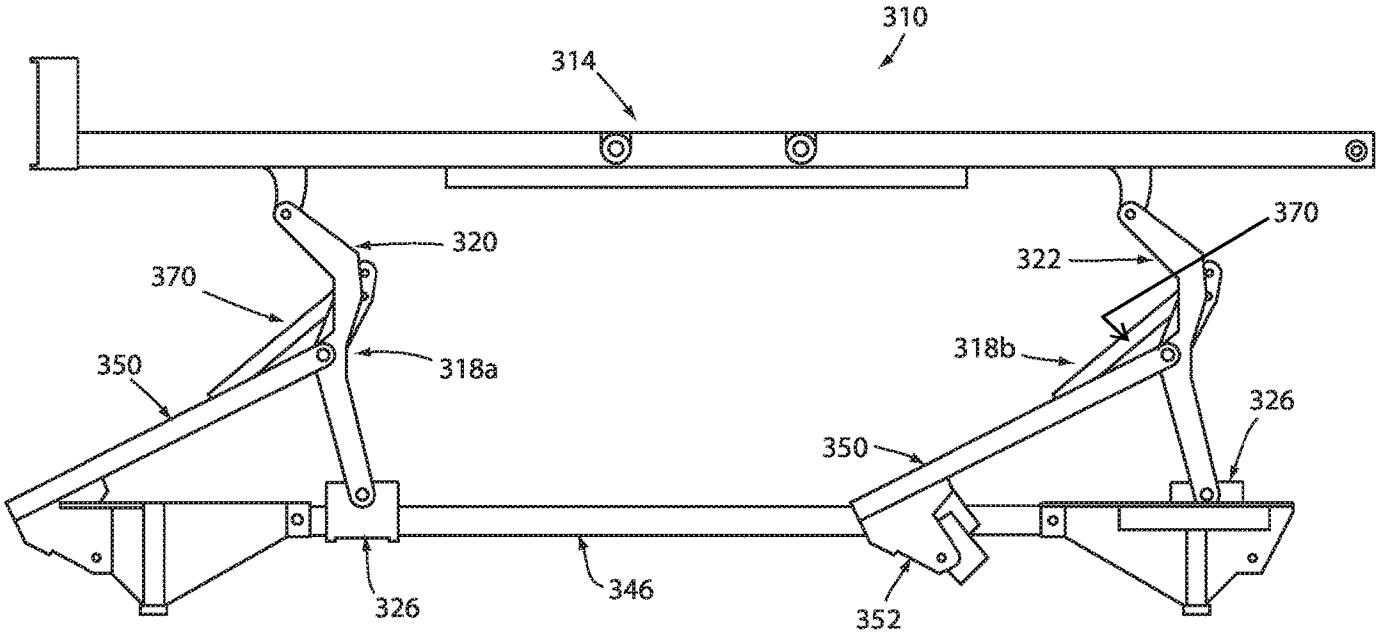
FIG. 54 is a side elevation view of another embodiment of lift assembly of FIGS. 45 through 53S with foot end lifting leg assemblies rotated 180° about the vertical axis.
Figure 55:
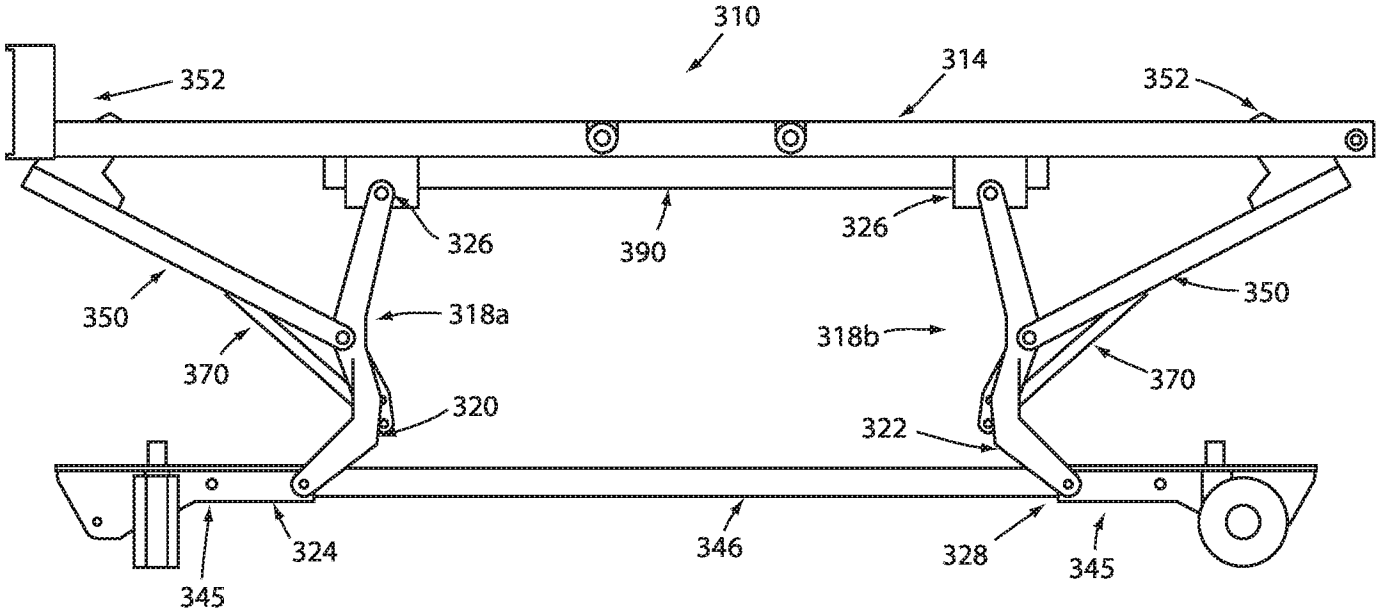
FIG. 55 is a side elevation view of another embodiment of lift assembly of FIGS. 45 through 53S with the foot end and head end lifting assembly inverted.

In addition, as best seen in FIG. 54, leg assembly 318*b* can be rotated 180° about the vertical axis. In this configuration, base member 352 of actuator frame 350 is pivotally mounted to longitudinal frame member 346 inward of foot end sliding pivot connection 326. Optionally, as noted, leg assemblies 318*a*, 318*b* may be inverted so that leg assemblies 318*a*, 318*b* each have an upright Y-shaped configuration, such as shown in FIG. 55. In this embodiment, sliding pivot connections 326 are mounted to a track 390 mounted the underside of frame 314. And, pivot connections 324, 328 are mounted to base frame members 342, 344, for example, by links 345. Consequently, in this embodiment, longitudinal frame member 346 may be eliminated.

As noted above one set of pivot connections 324, 328 may be movable. For example, when inverted, the movable pivot connections may include links pivotally mounted to the respective base frame member 342 or 344 or may be provided by the sliding pivot connections described above in reference to FIG. 45A, but which are instead provided at the base frame 314. Alternately, in yet another embodiment, one of the leg assemblies 318*a*, 318*b* (and its respective actuator) may be mounted so that the assembly slides along the long axis of frame 314 by using sliding connections of the type described above.

In the illustrated embodiment, the actuators comprise linear actuators with motors. Further, the motors are arranged in a plane that is perpendicular to the to the floor surface. With the present construction, however, the orientation of the motors may be rotated 90 degrees, so that the motor is arranged in a plane that is parallel to the floor surface.

Figure 53A:
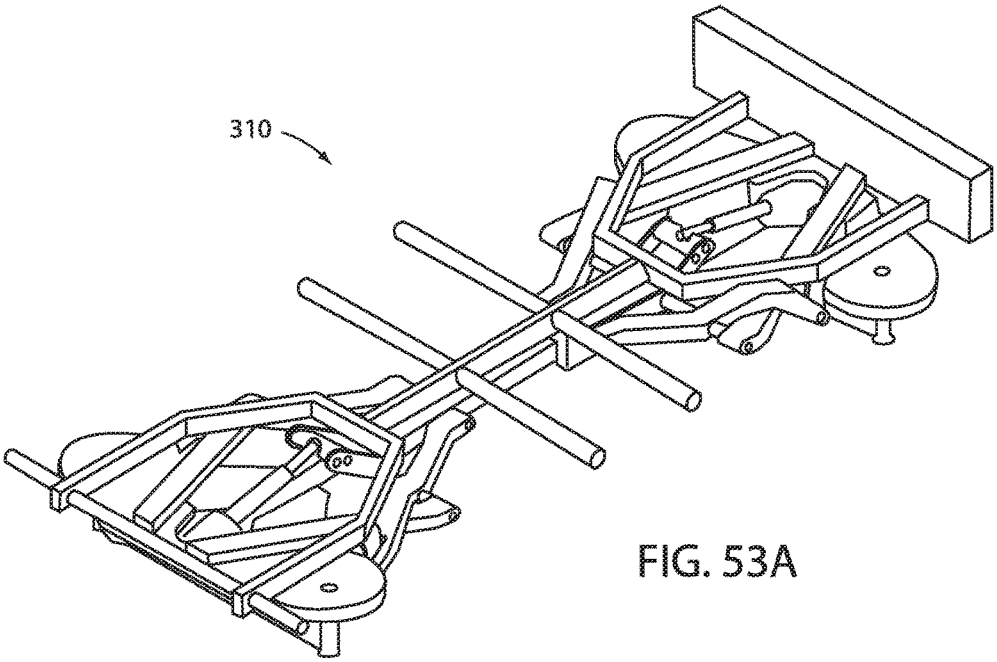
FIG. 53A is a similar view to FIG. 49 with the lift assembly in its lowermost configuration.
Figure 53B:
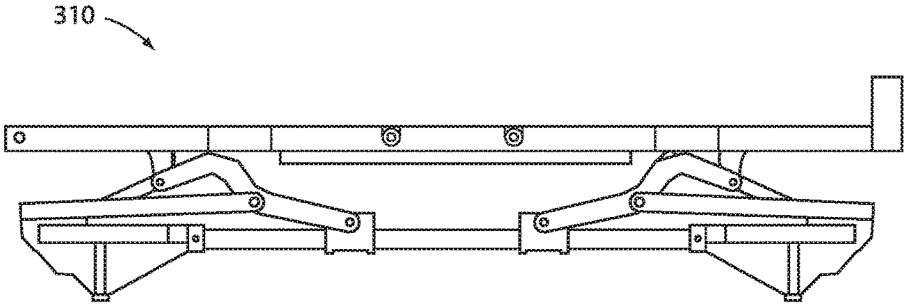
FIG. 53B is a similar view to FIG. 53A with the lift assembly in a raised configuration.
Figure 53C:
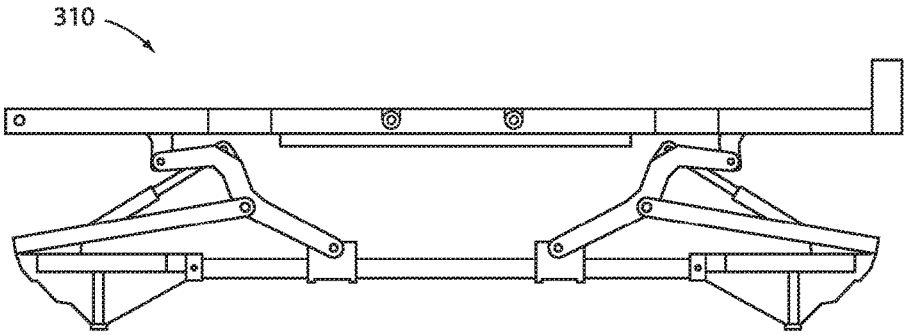
FIG. 53C is a similar view to FIG. 53B with the lift assembly in another raised configuration.
Figure 53D:
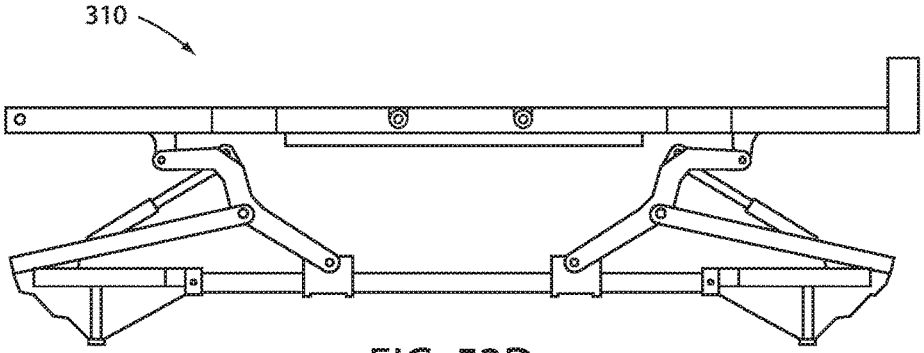
FIG. 53D is a similar view to FIG. 53C with the lift assembly in another raised configuration.
Figure 53E:
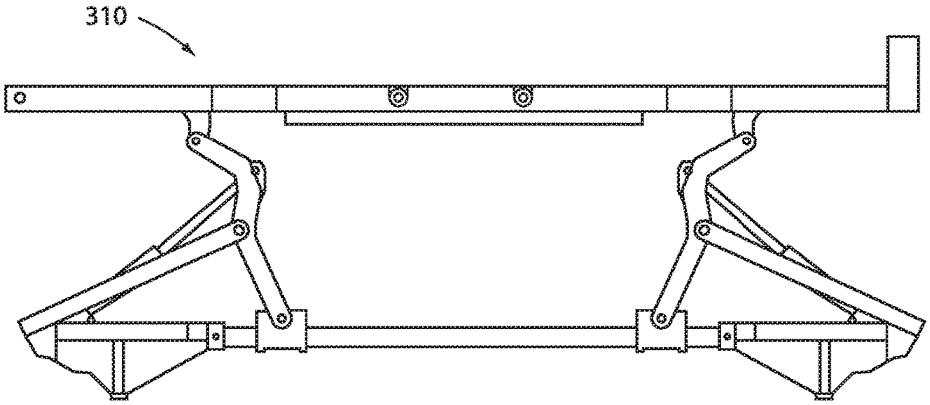
FIG. 53E is a similar view to FIG. 53D with the lift assembly in another raised configuration.
Figure 53F:
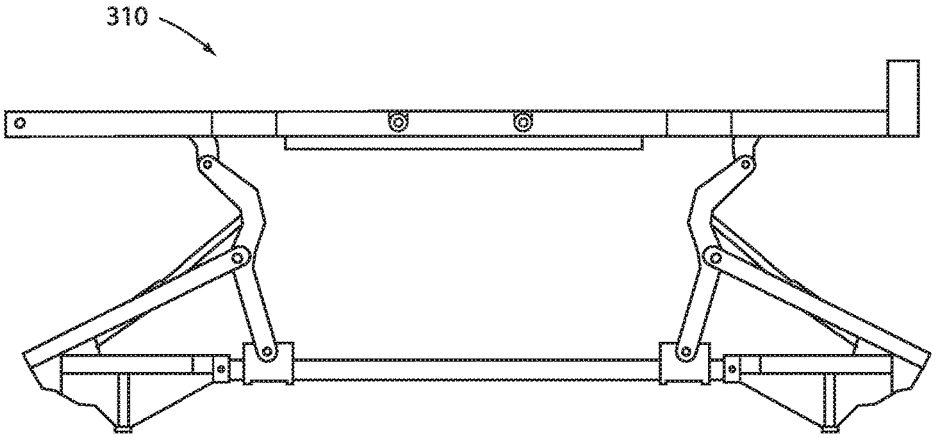
FIG. 53F is a similar view to FIG. 53E with the lift assembly in a full height configuration.
Figure 53G:
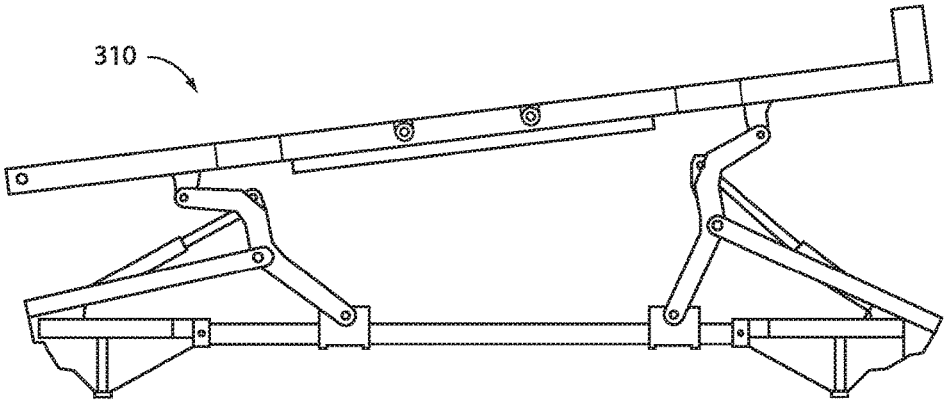
FIG. 53G is a similar view to FIG. 53F with the lift assembly tilted on one end toward a Trendelenburg position.
Figure 53H:
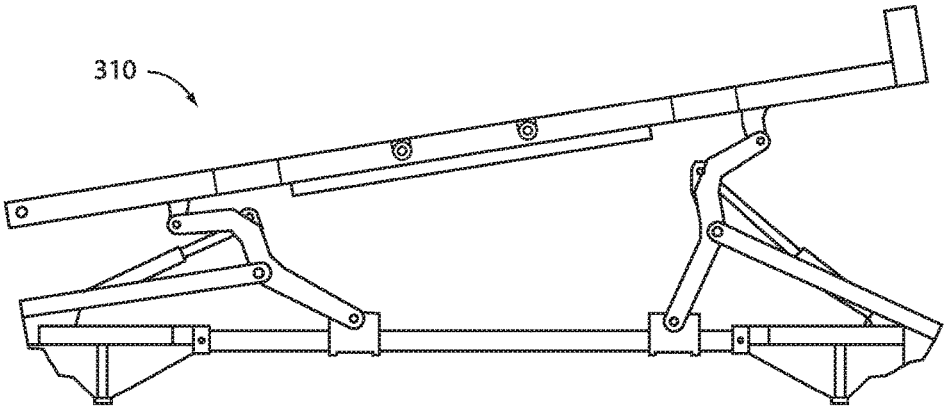
FIG. 53H is a similar view to FIG. 53G with the lift assembly tilted on one end toward a Trendelenburg position.
Figure 53I:
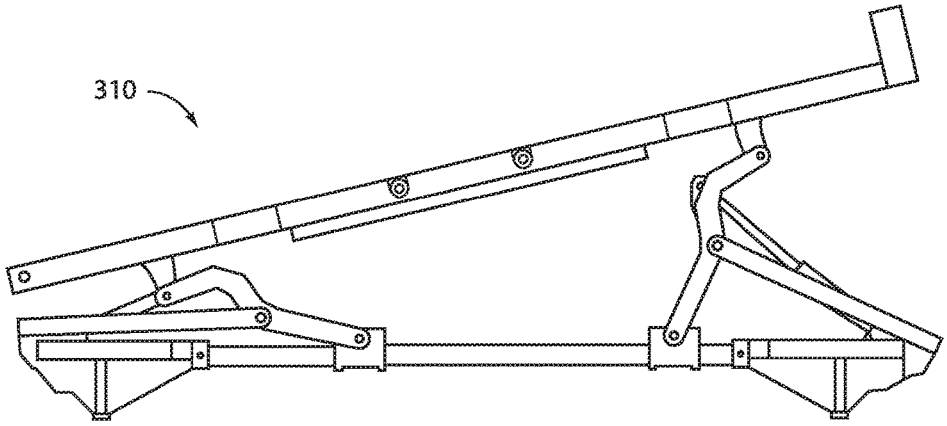
FIG. 53I is a similar view to FIG. 53H with the lift assembly in a full Trendelenburg position.
Figure 53J:
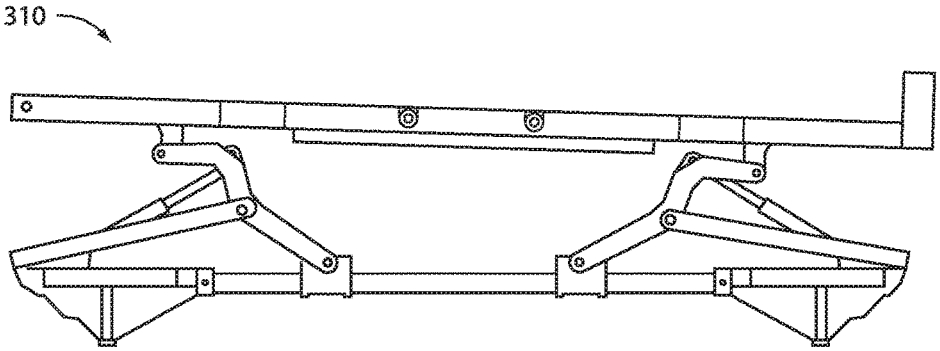
FIG. 53J is a similar view to FIG. 53I with the foot end of the lift assembly raising while the head end is lowering.
Figure 53K:
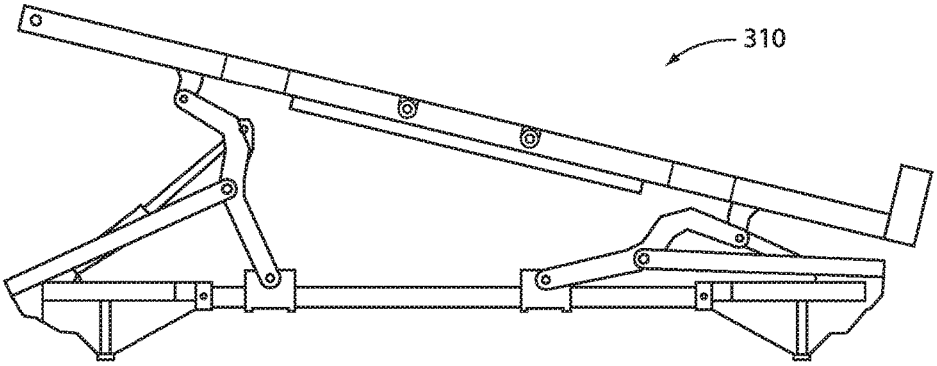
FIG. 53K is a similar view to FIG. 53J with the lift assembly in a full reverse Trendelenburg position.
Figure 53L:
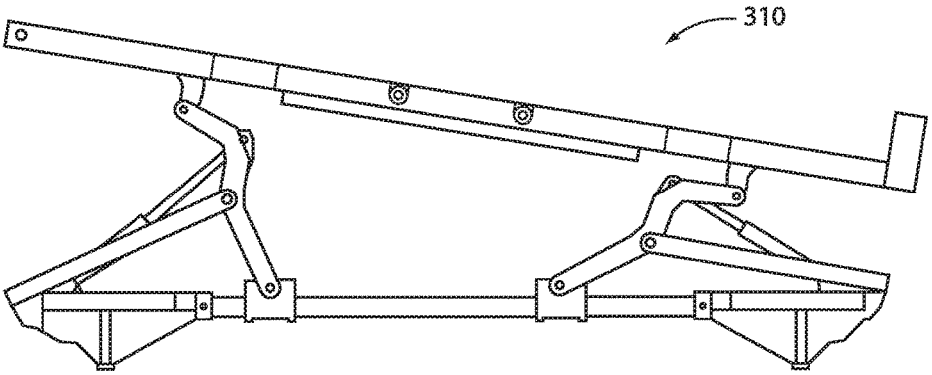
FIG. 53L is a similar view to FIG. 53J with the head end of the lift assembly raising.
Figure 53M:
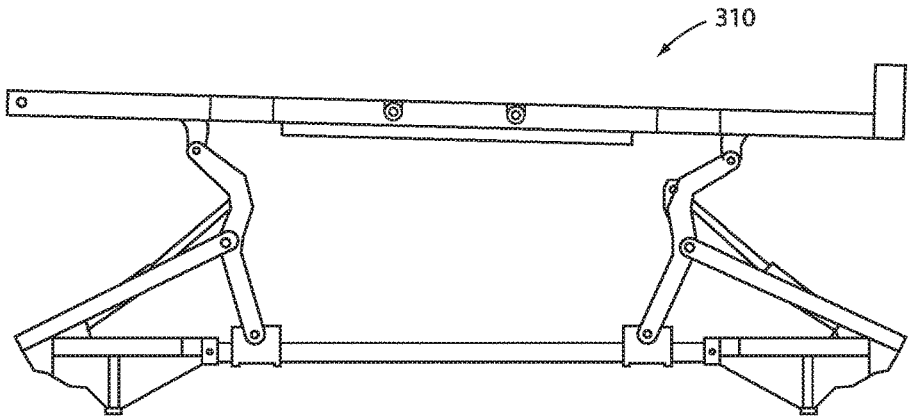
FIG. 53M is a similar view to FIG. 53L with the head end of the lift assembly raising.
Figure 53N:
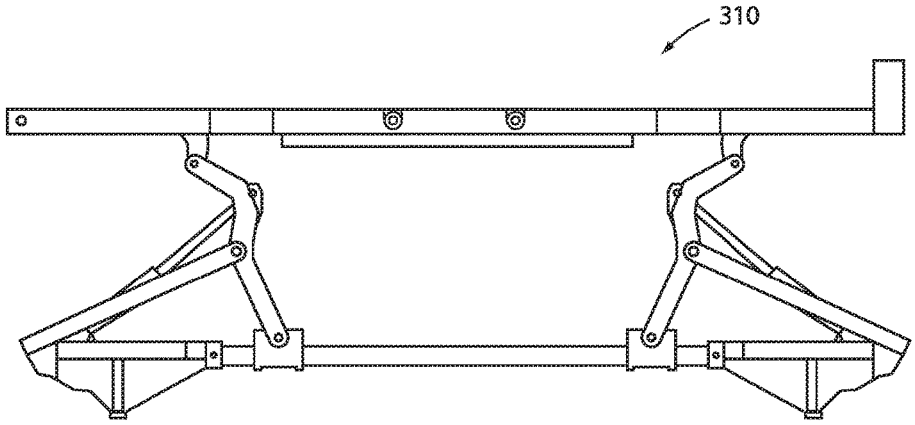
FIG. 53N is a similar view to FIG. 53A with the frame in a high height position.
Figure 53O:
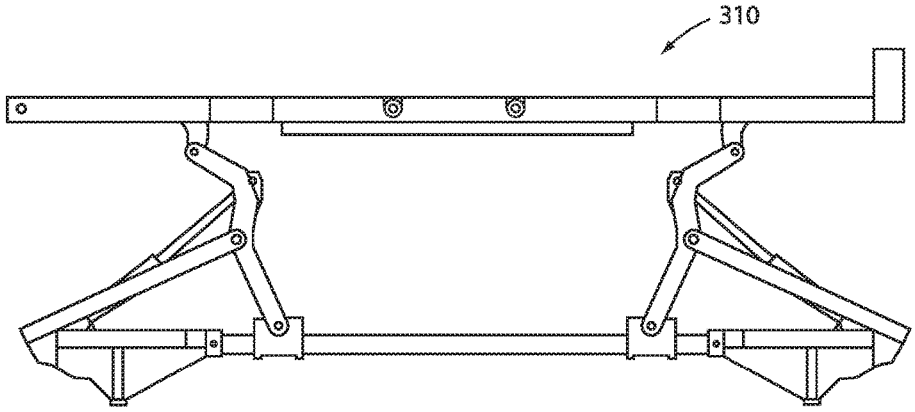
FIG. 53O is a similar view to FIG. 53N with the frame lowering.
Figure 53P:
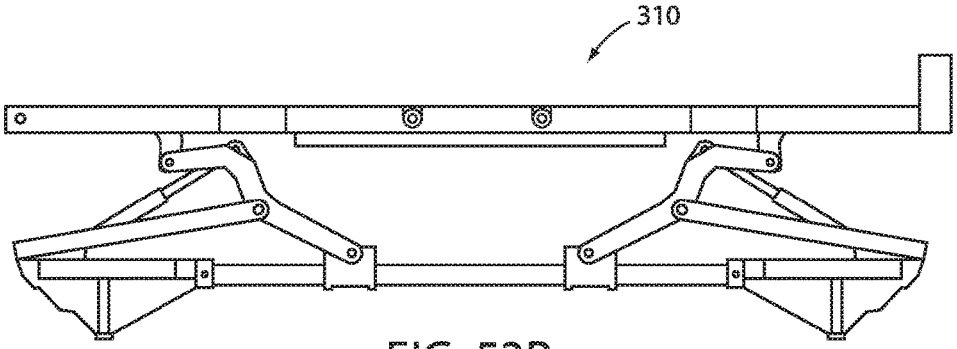
FIG. 53P is a similar view to FIG. 53O with the frame lowering further.
Figure 53Q:
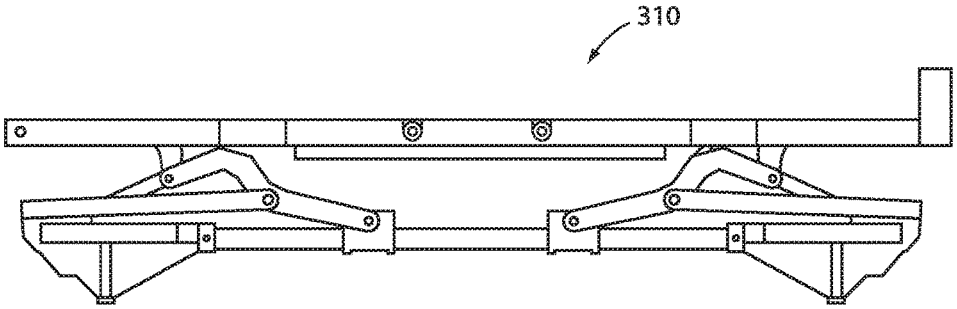
FIG. 53Q is a similar view to FIG. 53P with the frame lowering further.
Figure 53R:
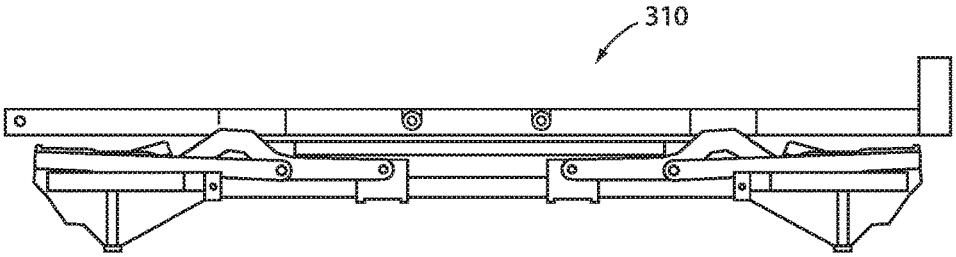
FIG. 53R is a similar view to FIG. 53Q with the frame lowering further.
Figure 53S:
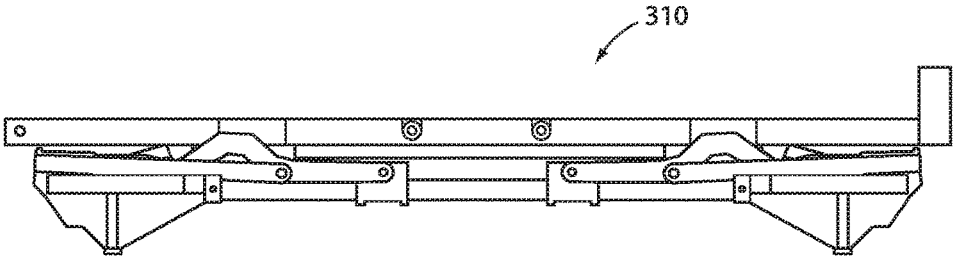
FIG. 53S is a similar view to FIG. 53R with the frame in its lowermost position.

Referring to FIGS. 53A-53S, the motion of lift assembly 218 is shown, starting from the lowermost position where the actuators are fully retracted (FIG. 53A). In the lowermost position, legs 320, 322 lie generally between the upper and lower planes of base frame 340, with the actuators' lower mounts extended below the base 312 and outside the footprint of the caster wheel assemblies 315. As actuators 370 extend, actuators 370 push on pivotal frame 357 to pivot and slide the lower ends of the respective lifting legs outward toward the opposed ends of the base, to thereby raise frame 314 to its high height position (FIGS. 53B-53F). FIGS. 53G-53H illustrate the foot end actuator contracting to move the frame into a Trendelenburg position. FIGS. 53I-53K illustrate the foot end actuator extending and the head end actuator contracting to move the frame 314 into a reverse Trendelenburg position. FIGS. 53L-53S illustrate the head end actuator extending to return the frame 314 to the high height position, followed by both actuators contracting to return the frame 314 to its lowermost position.

Though not described in each instance, it should be understood that the structural components of the frame, the deck, and the lift assembly may be formed from metal structural members that are either welded (as noted in some cases) or fastened together, e.g. by bolts, rivets, pins, or screws or the like, or simply mechanically interlocked (as noted above in reference to some of the brackets). Further, features on one embodiment may be combined with features of another embodiment or embodiments. Additionally, it should be understood that the actuators may be controlled to extend or contract independently, for example, so that they can raise or lower one end of the patient support apparatus to orient the patient support apparatus deck in a Trendelenburg or reverse Trendelenburg position.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to packages of any specific orientation(s).

Various alterations and changes can be made to the above-described embodiments without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

We claim:

1. A patient support apparatus comprising:

a base;

a frame supported relative to the base, the frame configured to support a deck for supporting a patient thereon; and a lift assembly for raising or lowering the frame relative to the base, the lift assembly including an actuator and a leg assembly coupled to the frame and the base, the leg assembly including at least one lifting leg, and the actuator mounted in the leg assembly between a first lever and a second lever, the first lever coupled to the lifting leg, and the second lever coupled to the base or the frame;

wherein the leg assembly comprises a head end leg assembly, the lift assembly further comprising a foot end leg assembly, and the foot end leg assembly including a lifting leg and an actuator.

2. The patient support apparatus according to claim 1, wherein the lifting leg includes an upper pivot connection to the frame, a lower pivot connection to the base, and a folding pivot axis between the upper and lower pivot connections, and the first lever eccentrically coupled to the lifting leg at the folding pivot axis.

3. The patient support apparatus according to claim 2, wherein the lower pivot connection comprises a sliding pivot connection, the sliding pivot connection sliding along a long axis of the base.

4. The patient support apparatus according to claim 3, wherein the first lever comprises an offset frame, the offset frame pivotally mounted about the folding pivot axis and pivotally mounted to the sliding pivot connection.

5. The patient support apparatus according to claim 4, wherein the offset frame comprises a pair of spaced plates, the spaced plates supporting a transverse pin, and the actuator pivotally coupled to the transverse pin.

6. The patient support apparatus according to claim 1, wherein the base includes a plurality of bearings.

7. The patient support apparatus according to claim 1, wherein the head end leg assembly and the foot end leg assembly each having an upright Y-shaped configuration when the lift assembly moves the frame to a raised position.

8. The patient support apparatus according to claim 1, wherein the head end leg assembly is independent of the foot end leg assembly.

9. The patient support apparatus according to claim 8, wherein the frame has a foot end and a head end, the lifting leg of the head end leg assembly being pivotally mounted at a fixed pivot connection at or near the head end of the frame, the lifting leg of the foot end leg assembly being pivotally mounted at a movable fixed pivot connection at or near the foot end of the frame.

10. The patient support apparatus according to claim 9, wherein the fixed pivot connection is offset below the frame by an arm.

11. The patient support apparatus according to claim 10, wherein the movable pivot connection is offset below the frame by an arm.

12. The patient support apparatus according to claim 8, wherein each of the head end leg assembly and the foot end leg assembly includes a pair of the lifting legs.

13. The patient support apparatus according to claim 12, wherein each of the actuators is mounted in a respective leg assembly between a first lever and a second lever, the first levers comprising pivotal frames, and each of the pivotal frames mounted between the pair of the lifting legs of the respective leg assembly.

14. The patient support apparatus according to claim 13, wherein each of the pivotal frames includes an offset frame, each offset frame comprising a pair of spaced plates, each of the pair of spaced plates supporting a transverse pin, and the actuators pivotally coupled to the transverse pins.

15. The patient support apparatus according to claim 1, wherein the head end leg assembly and the foot end leg assembly each having an inverted Y-shaped configuration when the lift assembly moves the frame to a raised position.

16. A patient support apparatus comprising:

a base, the base having a base frame;

a support frame supported relative to the base, the support frame configured to support a deck for supporting a patient thereon;

a head end actuator;

a foot end actuator; and a lift assembly for raising or lowering the frame relative to the base, the lift assembly including a head end leg assembly and a foot end leg assembly, each of the leg assemblies having a Y-shaped configuration when the frame is raised and being folded when the frame is lowered, the head end leg assembly and the foot end leg assembly each having a pair of lifting legs, the lifting legs pivotally mounted at their upper ends to the frame and pivotally mounted at their lower ends to the base, each of the lifting legs having a folding pivot axis, and each of the head end and foot end actuators having a lower pivot connection below the base frame and an upper pivot connection above the folding pivot axis of a respective pair of lifting legs of the lifting legs.

17. The patient support apparatus according to claim 16, wherein each of the actuators is mounted in a respective leg assembly between a first lever and a second lever, the first levers comprising pivotal frames, and each of the pivotal frames mounted between the pair of the lifting legs of a respective leg assembly of the head end leg assembly and the foot end leg assembly.

18. The patient support apparatus according to claim 16, wherein the head end leg assembly and the foot end leg assembly each have an inverted Y-shaped configuration when the lift assembly moves the frame to a raised position.

19. The patient support apparatus according to claim 16, wherein the frame has a foot end and a head end, the lifting legs of the head end leg assembly being pivotally mounted at fixed pivot connections at or near the head end of the frame, the lifting legs of the foot end leg assembly being pivotally mounted at movable fixed pivot connections at or near the foot end of the frame.

20. The patient support apparatus according to claim 19, wherein the fixed pivot connections are offset below the frame.

21. The patient support apparatus according to claim 19, wherein the movable pivot connections are offset below the frame.

* * * * *